US006930578B2

(12) United States Patent
Thibault et al.

(10) Patent No.: US 6,930,578 B2
(45) Date of Patent: Aug. 16, 2005

(54) FIELD ADJUSTABLE PHASE SHIFTING TRANSFORMER

(75) Inventors: Yvan Thibault, Granby (CA); Jean-Guy Boudrias, Laval (CA); Stéphane Brouillette, Granby (CA); Guy Pregent, Otterburn Park (CA)

(73) Assignee: Delta Transformers of Canada (1999) Ltd., Quebec (CA)

( * ) Notice: Subject to any disclaimer, the term of this patent is extended or adjusted under 35 U.S.C. 154(b) by 125 days.

(21) Appl. No.: 10/369,371

(22) Filed: Feb. 18, 2003

(65) Prior Publication Data

US 2004/0119571 A1 Jun. 24, 2004

Related U.S. Application Data

(63) Continuation-in-part of application No. 10/328,869, filed on Dec. 24, 2002, now abandoned.

(51) Int. Cl.[7] ..... H01F 30/12
(52) U.S. Cl. ..... 336/5
(58) Field of Search ..... 336/5, 10, 12; 307/105; 363/64, 154; 323/361

(56) References Cited

U.S. PATENT DOCUMENTS

| | | | | | |
|---|---|---|---|---|---|
| 4,862,059 | A | * | 8/1989 | Tominaga et al. | 323/307 |
| 5,343,080 | A | | 8/1994 | Kammeter | 307/105 |
| 5,434,455 | A | * | 7/1995 | Kammeter | 307/105 |
| 5,543,771 | A | | 8/1996 | Levin | 336/10 |
| 5,977,761 | A | * | 11/1999 | Bilger et al. | 323/361 |
| 6,169,674 | B1 | | 1/2001 | Owen | 363/64 |

* cited by examiner

*Primary Examiner*—Tuyen T Nguyen
(74) *Attorney, Agent, or Firm*—Olson & Hierl, Ltd.

(57) ABSTRACT

A field-adjustable phase shifting transformer apparatus for canceling harmonic currents in a three-phase alternating current (AC) power distribution system includes a primary having a plurality of sets of contact points for receiving power from a three-phase AC power source and a secondary electromagnetically coupled to the primary, the secondary having a single set of contact points for connection to a plurality of loads. A phase shift is chosen by selecting one of the sets of contacts for connecting the primary to the AC power source.

4 Claims, 27 Drawing Sheets

PRIMARY: 3 WINDINGS, 2 SETS OF CONTACT POINTS, WITHOUT NEUTRAL POINT

PRIMARY: 3 WINDINGS, 2 SETS OF CONTACT POINTS, WITHOUT NEUTRAL POINT

PRIMARY: 6 WINDINGS, 2 SETS OF CONTACT POINTS, WITHOUT NEUTRAL POINT

SECONDARY: 6 WINDINGS, 1 SET OF CONTACT POINTS

SECONDARY: 9 WINDINGS, 1 SET OF CONTACT POINTS

SECONDARY: 9 WINDINGS, 2 SETS OF CONTACT POINTS

SECONDARY: 15 WINDINGS, 2 SETS OF CONTACT POINTS

2000

FIELD ADJUSTABLE PHASE SHIFTING TRANSFORMER

CROSS-REFERENCE TO RELATED APPLICATIONS

This is a continuation-in-part of U.S. patent application Ser. No. 10/328,869 filed on Dec. 24, 2002, now abandoned.

TECHNICAL FIELD

The invention relates to three-phase power transformers and in particular to a field-adjustable phase shifting transformer for canceling harmonic currents in a three-phase alternating current (AC) power distribution system.

BACKGROUND OF THE INVENTION

Harmonic currents present in a power distribution network can present significant problems, including power losses, overheating, resonances and over-voltages, operational instability, and radio frequency disturbances. Any electronic circuit which presents a non-linear load to the power source will inherently generate harmonic currents. Power thyristors, rectifiers, and switching-mode power supplies commonly used in data processing and telecommunications equipment are inherently non-linear and are a major cause of power supply degradation due to generation of harmonics. The technique of using phase shifting transformers to cancel the harmonics in power distribution systems is well known.

As is well understood, loads on a power distribution system are generally unknown prior to installation of the power distribution system. Even when initially predicted, the loads often change as equipment is added to or removed from the system. It is thus advantageous to be able to adjust phase shifting transformers in the field after initial installation.

U.S. Pat. No. 5,543,771 to Levin, which issued Aug. 6, 1996, teaches a phase shifting polygonal transformer or autotransformer for a three-phase electrical distribution system, in which the transformer output winding or autotransformer winding is composed solely of three main coils and three auxiliary coils, alternately interconnected in series. The outputs of the transformer/autotransformer are connected to taps in the coils offset from the connections between the coils. However, Levin does not provide field-adjustable phase shifting.

U.S. Pat. No. 6,169,674 to Owen, which issued Jan. 2, 2001, teaches a transformer for controlling harmonic currents by enabling different phase relationships to be set, and changed in the field, between devices being energized and the power source providing the energization. Owen teaches transformers of closed polygon configurations. This has particular application, for example, in canceling harmonics caused by multiple six-pulse variable frequency drives used for controlling connected three-phase induction motors that operate electric submersible pumps. The transformer used to achieve this has two winding groups, each with two sets of contacts at different phase relationships.

U.S. Pat. No. 5,343,080, which issued to Kammeter on Aug. 30, 1994, teaches a harmonic current filtering transformer that includes a three-phase input winding and at least two wye-connected three-phase output windings. The output windings are phase shifted relative to each other by an amount which causes harmonic currents generated by a non-linear load to magnetically cancel in the transformer core. Kammeter does not provide selection of different phase shifts in the field.

Consequently, aside from Owens transformer, which is complex to construct and install, and adapted to a single purpose, the prior art fails to teach an efficient and economical solution for harmonic cancellation, especially harmonics on a common supply bus which affect power losses in the distribution grid.

There therefore exists a need for a field-adjustable phase shifting transformer for canceling harmonic currents in a three-phase power system that facilitates transformer construction and field adjustability.

SUMMARY OF THE INVENTION

It is an object of the invention to provide a three-phase transformer with field adjustability that is simple and economical to produce.

Therefore, according to an aspect of the invention there is provided a field-adjustable phase shifting transformer for canceling harmonic currents in a three-phase alternating current (AC) power distribution system, the transformer including a primary having a plurality of sets of contact points for receiving power from a three-phase AC power source and a secondary electromagnetically coupled to the primary having a single set of contact points for connection to a plurality of loads. Each set of contact points of the primary provides a respective primary-to-secondary phase shift and a current from each set of contact points of the primary is relative to the primary-to-secondary phase shift.

According to another aspect of the invention there is provided a method for connecting a field-adjustable phase shifting transformer within a three-phase AC power distribution system. In accordance with the method, a first plurality of loads are connected to contacts of a secondary of a first transformer having a primary with a plurality of contact sets. Next, a second plurality of loads are connected to contacts of a secondary of a second transformer having a primary with a plurality of contact sets. One of the plurality of contact sets of the primary of the first transformer and one of the plurality of contact sets of the primary of the second transformer are chosen for connection to a common primary bus so that an identified harmonic component of a current from the primary of the first transformer and a current from the primary of the second transformer will substantially cancel in the common primary bus, when the chosen contact set of the primary of the first transformer and the chosen contact set of the primary of the second transformer are connected to the primary bus.

According to yet another aspect of the invention there is provided a method for modifying a transformer in a three-phase AC power distribution system to cancel harmonic currents through a common primary bus. The method involves receiving a three-phase AC voltage from an AC power source at a primary of a first transformer and a primary of a second transformer that is connected in parallel with the primary of the first transformer, to provide a first transformed three-phase voltage to a first plurality of loads using a secondary of the first transformer, and a second transformed three-phase voltage to a second plurality of loads using a secondary of the second transformer. A primary-to-secondary phase angle of a current in the primary of the first transformer is shifted by a first predetermined amount is adjusted by and adjusting a phase angle of a current in the primary of the second transformer by a second predetermined amount by changing a set of contacts used for connection to the AC power source in each of the primaries of the transformers so that harmonic components contributed by the primary of the first transformer and the primary of the second transformer substantially cancel each other out in the common primary bus.

In accordance with a further aspect of the invention, a method for designing a transformer adapted for in-field reconfiguration to provide an adjustable primary-to-secondary phase shift in a three-phase AC distribution system. The method of designing involves selecting a transformer configuration type, including a number of windings, a core configuration, and an order of windings in legs of the core. Providing contact points on a secondary of the transformer for connection to a plurality of loads, and a plurality of sets of contact points on a primary, each of which are adapted to receive power from a three-phase AC power source, so that each of the sets of contact points on the primary defines a respective primary-to-secondary phase angle with respect to the secondary.

Provided in accordance with yet a further aspect of the invention is a field-adjustable primary for a transformer for use in a three-phase alternating current (AC) power distribution system. The primary includes a plurality of sets of contacts adapted to receive a three-phase AC voltage from an AC power source, although in operation only one set of contacts is used. In accordance with this aspect of the invention, each of the sets of contacts provides a different respective primary-to-secondary phase shift with respect to a given secondary, so that the primary can be modified by using a different set of the contacts in order to provide a different primary-to-secondary phase shift. The secondary of the transformer has multiple outputs and windings with a plurality of sets of contact points. In one embodiment of the transformer, the secondary winding is zig-zag-wye-connected.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

The invention provides a field-adjustable, phase shifting transformer that is simple and economical to produce. As is well known, in the AC power distribution system transformers are generally step-down transformers. In step-down transformers, the windings in the primary are of a lighter gauge than the winding in the secondary. It is therefore more economical to keep the secondary of a step-down transformer as simple as possible, because it is easier to construct complex coils with the lighter gauge windings. Also, because the current on the primary side is lower than the current on the secondary side, the material required for contact points on the primary side is less than that required on the secondary side. Less expensive and smaller enclosures therefore suffice for the primary, in comparison with the secondary. Consequently, transformers in accordance with the invention include contact points for field adjustability only in the primary. This is also advantageous in that it permits the phase of two or more transformers connected to a common supply bus to be connected to the bus so that harmonic currents on a common supply bus are canceled. Power loss in the supply grid is thereby reduced.

Figure 1:
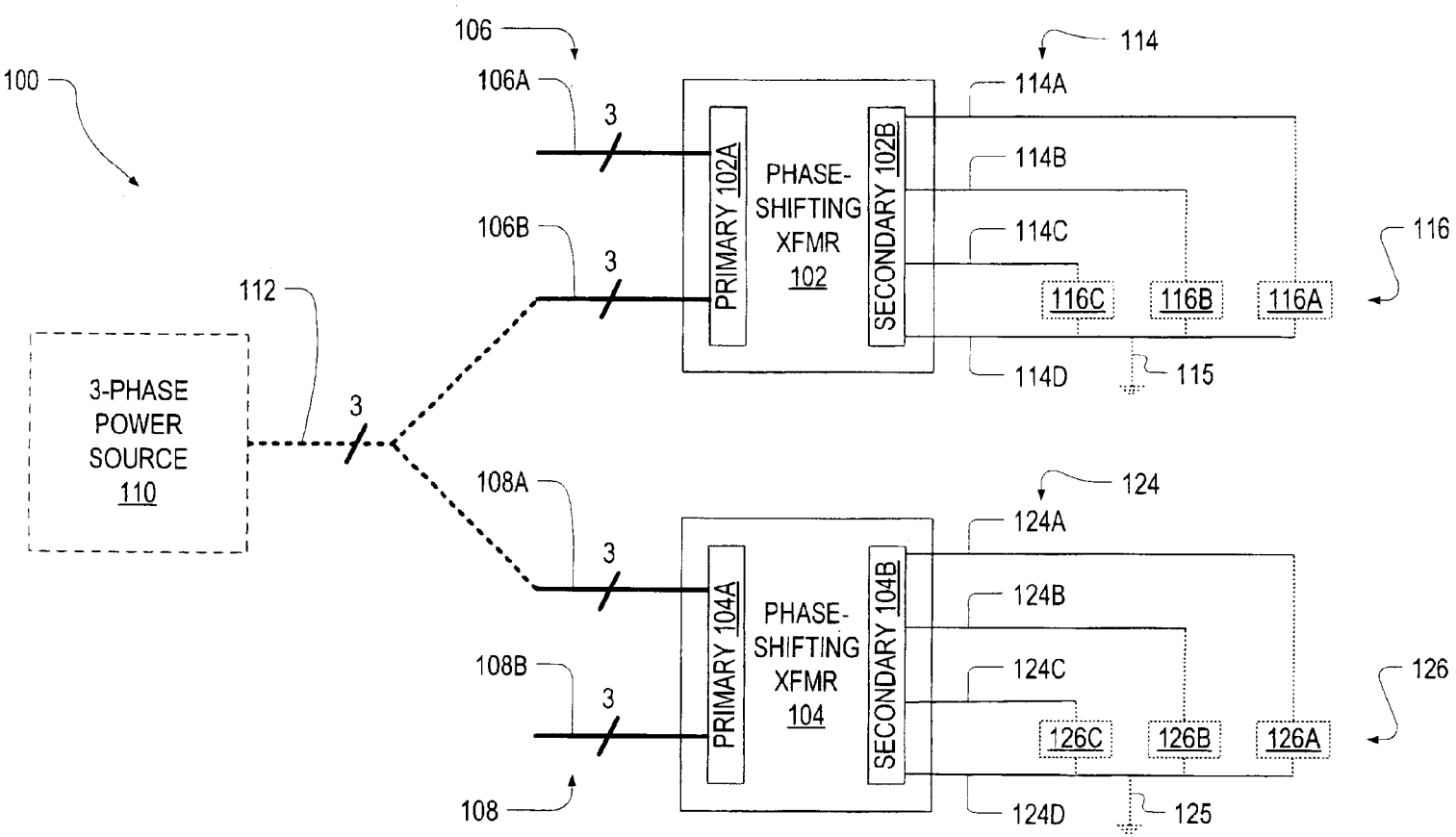
FIGS. 1 to 3 are schematic diagrams of respective three-phase alternating current (AC) power distribution systems including field-adjustable phase shifting transformers in accordance with the invention.

FIG. 1 shows schematic diagram of an exemplary three-phase alternating current (AC) power distribution system 100 including a first transformer 102 and a second transformer 104 in accordance with the invention. The first transformer 102 has a primary 102A with two sets of contact points 106: a first set of contact points 106A, and a second set of contact points 106B. Similarly, the second transformer 104 has a primary 104A with two sets of contact points 108: a first set of contact points 108A, and a second set of contact points 108B. The primary 102A of first transformer 102 and the primary 104A of the second transformer 104 are connectable in parallel to a three-phase AC power source 110 via a three-wire primary bus 112. The primary bus 112 may be connected to any one of the contact points 106 of the primary 102A of first transformer 102 and any one of the contact points 108 of the primary 104A of the second transformer 104.

The first transformer 102 also has a secondary 102B with a single set of contact points 114: a first contact point 114A, a second contact point 114B, a third contact point 114C and a fourth point 114D. The secondary 102B is electromagnetically coupled to the primary 102A in a manner well know in the art. The fourth contact point 114D is connectable to a ground reference 115. The contact points 114 are connectable to loads 116: a first load 116A connectable from the first contact point 114A to the fourth contact point 114D, a second load 116B connectable from the second contact point 114B to the fourth contact point 114D, and a third load 116C connectable from the third contact point 114C to the fourth contact point 114D. Each of the loads 116 may be, for example, an aggregation of power consuming devices such as telecommunications equipment or computers which may have switch mode power supplies, rectifiers, or thyristors which are inherently non-linear and cause harmonic currents to flow in the secondary 102B and primary 102A of the transformer 102. The loads 116 may also be single-phase, non-linear loads in accordance with the illustrated embodiment, however in alternative embodiments, other types of loads, including three-phase non-linear loads, or single-phase or three-phase linear loads such as motors and resistors.

The second transformer 104 also has a secondary 104B connectable in an identical manner as the secondary 102B of the first transformer 102.

It should be noted that the power distribution system 100 is shown having two identical transformers 102,104 for convenience. However, more than two transformers (not shown) may be used in the system 100 and the transformers 102,104 need not be identical.

Connection of the primary bus 112 to one of the contact points 106,108 of each of primaries 102A,104A provides a different phase shift of a current of the respective primary relative to a voltage of the primary bus 112. The contacts 106,108 for connection to the primary bus 112 are chosen so that an identified harmonic of a current from the primary 102A of the first transformer 102 and a harmonic of a current from the primary 104A of the second transformer 104 substantially cancel, and do not propagate to the primary bus 112.

Figure 2:
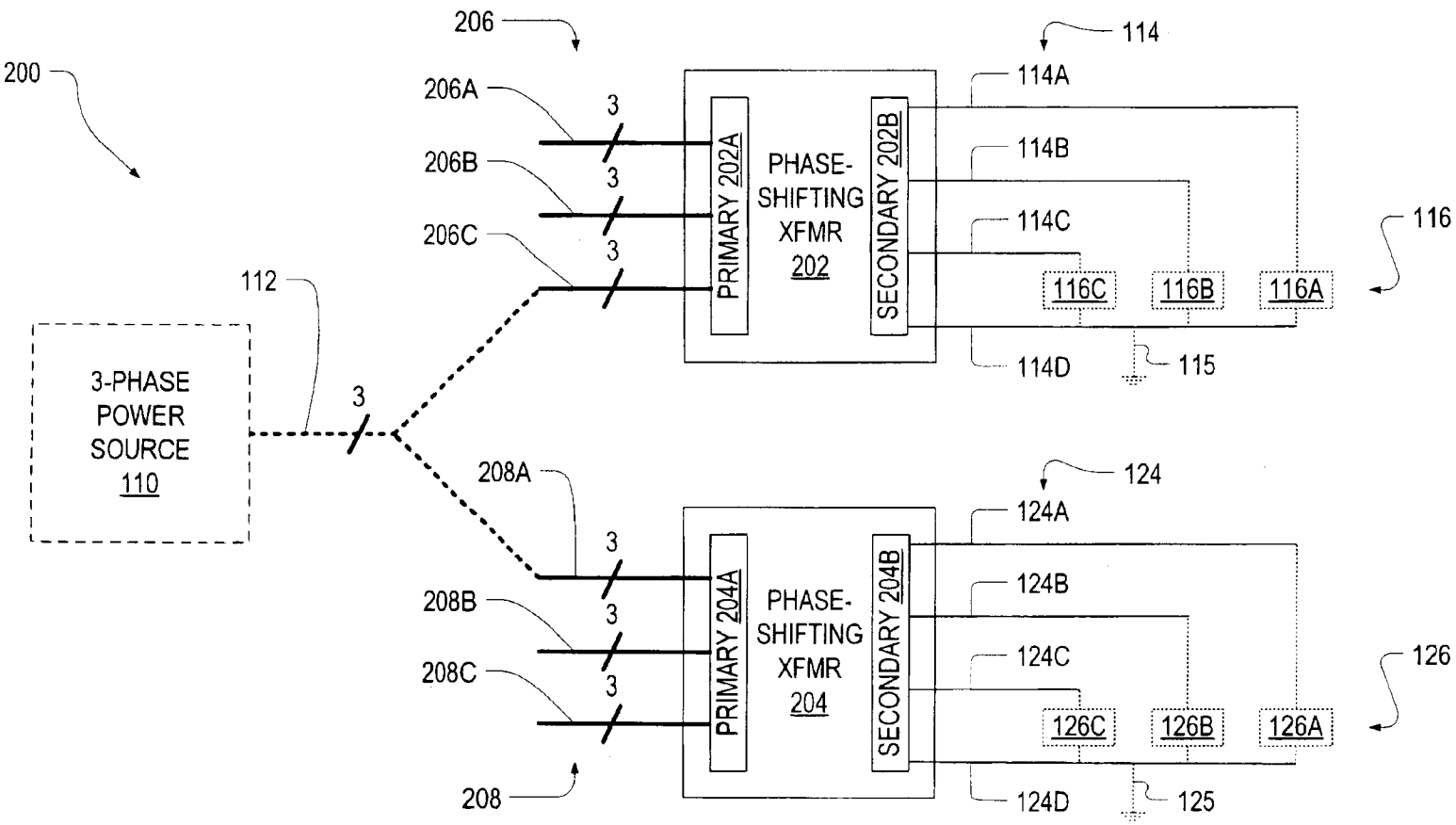

FIG. 2 shows another exemplary power distribution system 200 that is identical to the system 100 shown in FIG. 1 except that a primary 202A of a first transformer 202 and a primary 204A of a second transformer 204 have three sets of contact points 206,208.

Figure 3:
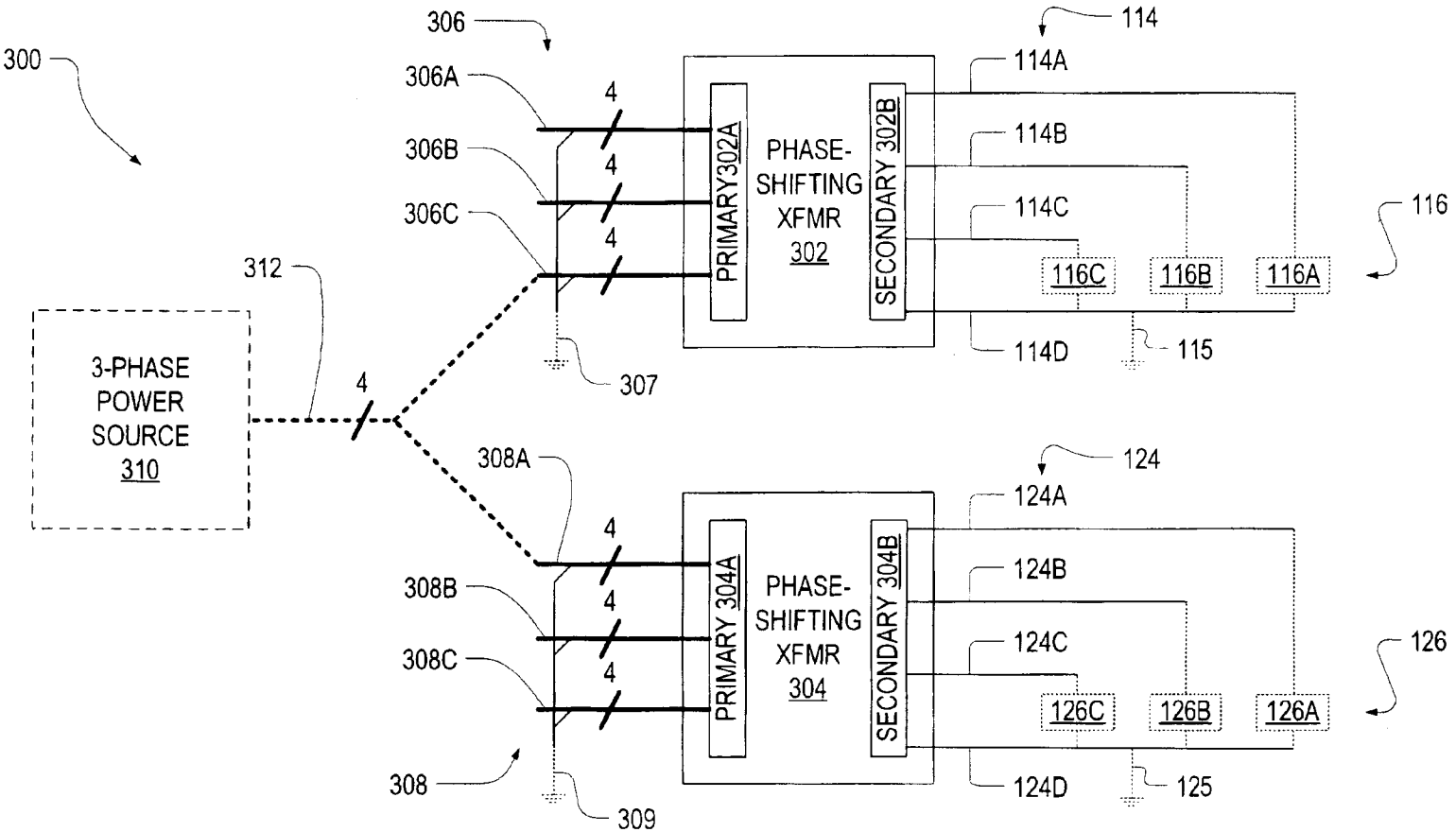

FIG. 3 shows yet another exemplary power distribution system 300 that is identical to the system 200 shown in FIG. 2, except that contacts 306 of a primary 302A of a first transformer 302 and contacts 308 of a primary 304A of a second transformer 304 are connectable to a three-phase AC power source 310 via a four-wire primary bus 312.

Figure 4:
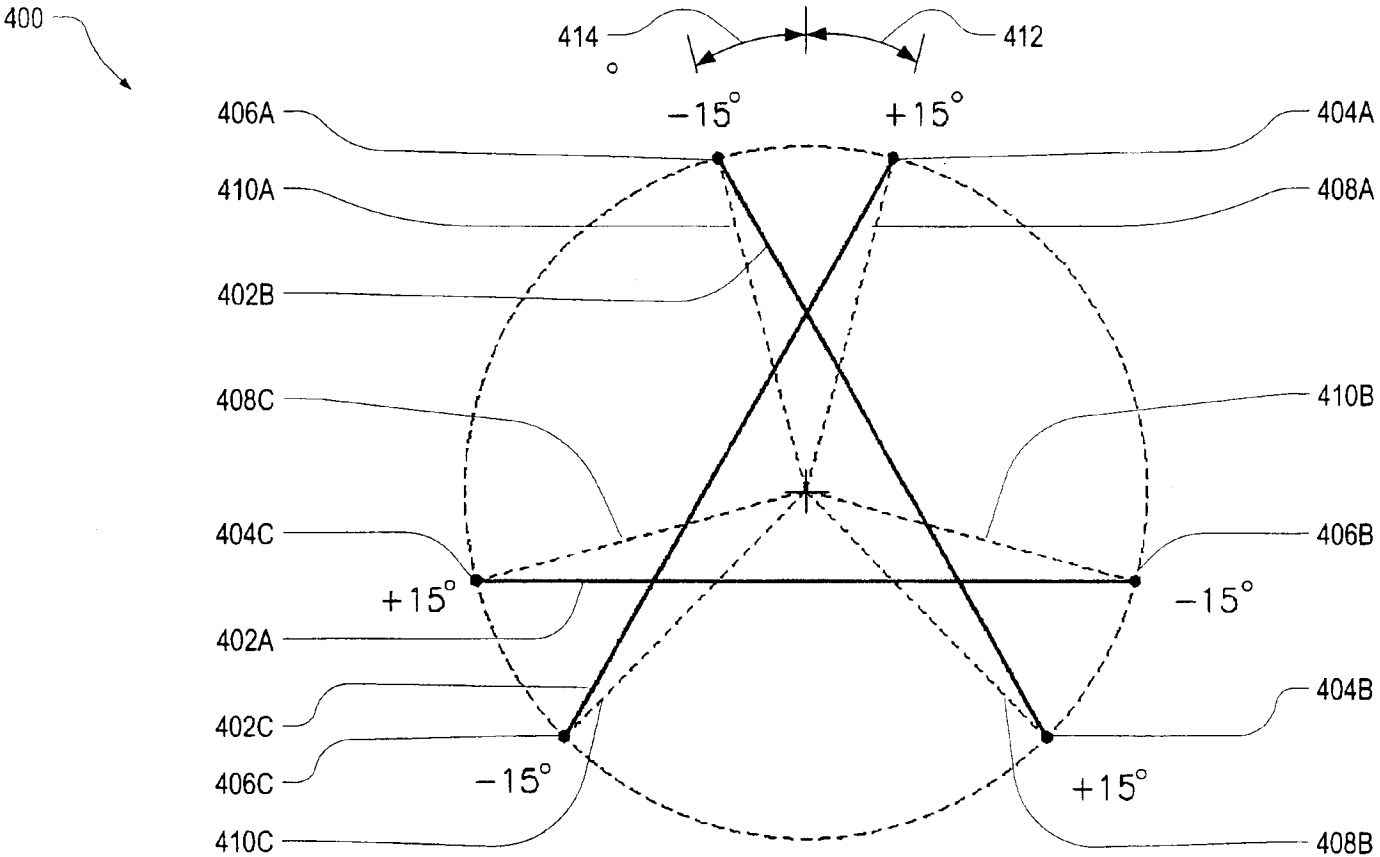
FIGS. 4 and 5 are phasor diagrams of exemplary primaries of a transformer in accordance with the invention.
Figure 5:
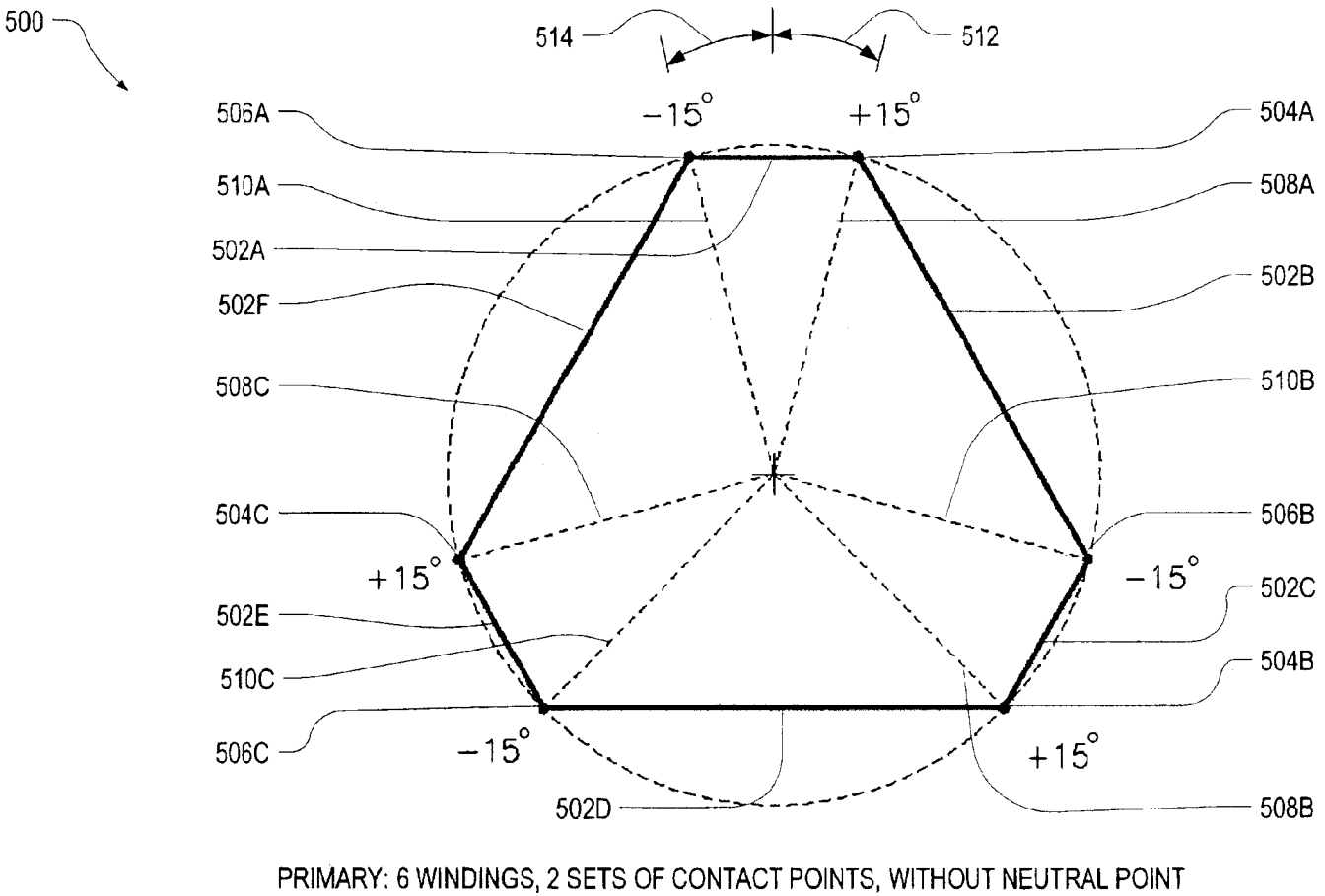

FIGS. 4 and 5 show phasor diagrams 400,500 of preferred embodiments of the primary 102A of the first transformer 102 or the primary 104A of the second transformer 104 shown in FIG. 1. That is, a primary corresponding to the phasor diagram 400 shown in FIG. 4 may be used as the primary 102A of the first transformer 102 or the primary 104A of the second transformer 104 or both. Similarly, a primary corresponding to the phasor diagram 500 shown in FIG. 5 may be used as the primary 102A of the first transformer 102, or the primary 104A of the second transformer 104, or both.

A primary corresponding to the phasor diagram 400 shown in FIG. 4 has three windings 402A,402B,402C connected in a delta-star configuration, and two sets of contact points: a first set of contact points 404A,404B,404C (corresponding to the first set of contacts 106A of the primary 102A of the first transformer 102, or to the first set of contacts 108A of the primary 104A of the second transformer 104) and a second set of contact points 406A,406B, 406C (corresponding to the second set of contacts 106B of the primary 102A of the first transformer 102, or to the second set of contacts 108B of the primary 104A of the second transformer 104). The first set of contact points 404A,404B,404C provide a first three-phase current in relation with a first primary-to-secondary phase shift 412 408A, 408B, 408C and the second set of contact points 406A, 406B, 406C provide a second three-phase current in relation with a second primary-to-secondary phase shift 414 410A, 410B,410C. As will be appreciated by those of skill in the art, the primary-to-secondary phase shift is a product of both the primary and the secondary winding configurations, and so a primary winding configuration has only a primary-to-secondary phase shift with respect to a given secondary, and substituting a secondary winding configuration will change the primary-to-secondary phase shift, accordingly. In this embodiment, the first primary-to-secondary phase shift 412 is +15° and the second primary-to-secondary phase shift 414 is −15° with a secondary winding configuration like that shown on the FIG. 15A. However the first primary-to-secondary phase shift 412 may range between 1° and 120°, and the second primary-to-secondary phase shift 414 may range between −1° and −120°, without departing from the scope of the invention.

A phasor diagram 500 shown in FIG. 5 employs a primary bearing a same primary-to-secondary phase shift with respect to a given secondary winding configuration as the primary corresponding to the phasor diagram 400 shown in FIG. 4. The principal difference between the phasor diagrams of FIGS. 4 and 5 are the number of windings (3 vs. 6 respectively) and respective winding configurations. The phasor diagram 500 illustrates six windings 502A,502B, 502C,502D,502E,502F connected in a closed polygon configuration, and is adapted to provide a +/−15° phase shift with respect to the secondary (such as the secondary illustrated in FIG. 15A).

FIGS. 6 to 9, and 12A to 13B show phasor diagrams 600,700,800,900,1200,1201,1300,1301 corresponding to preferred embodiments of the primary 202A of the first transformer 202 or the primary 204A of the second transformer 204 shown in FIG. 2. That is, a primary corresponding to one of the phasor diagrams 600,700,800,900,1200, 1201,1300,1301 may be used as the primary 202A of the first transformer 202, the primary 204A of the second transformer 204, or both.

Figure 6:
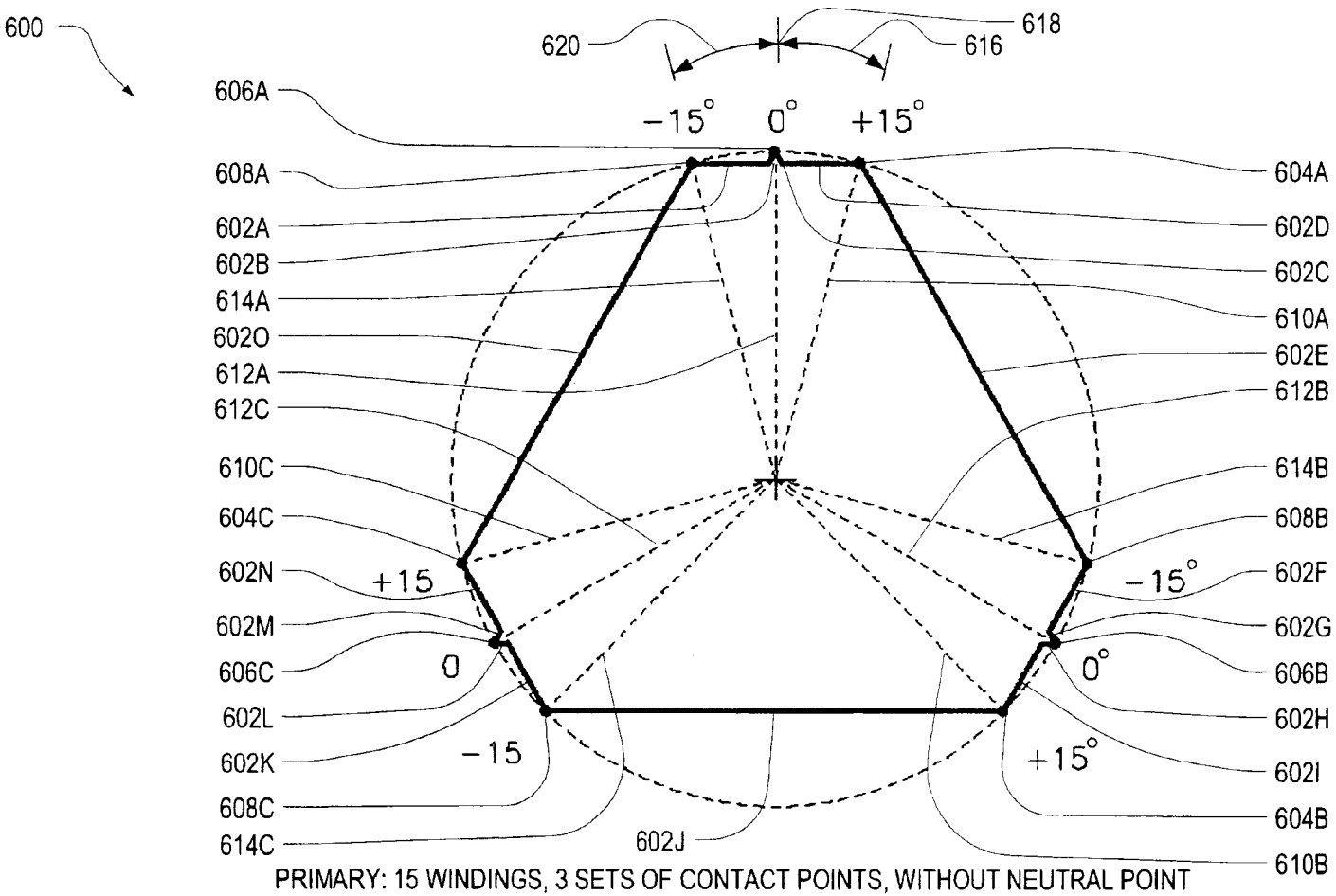
FIGS. 6 to 9 are phasor diagrams of exemplary primaries of a transformer in accordance with the invention.

A primary corresponding to the phasor diagram 600 shown in FIG. 6 has fifteen windings 602A,602B,602C, 602D,602E,602F,602G,602H,602I,602J,602K,602L,602M, 602N 602O connected in a closed polygon configuration and three sets of contact points: a first set of contact points 604A,604B,604C (corresponding to the first set of contacts 206A of the primary 202A of the first transformer 202 or to the first set of contacts 208A of the primary 204A of the second transformer 204), a second set of contact points 606A,606B,606C (corresponding to the second set of contacts 206B of the primary 202A of the first transformer 202 or to the second set of contacts 208B of the primary 204A of the second transformer 204), and a third set of contact points 608A,608B,608C (corresponding to the third set of contacts 206C of the primary 202A of the first transformer 202 or to the third set of contacts 208C of the primary 204A of the second transformer 204). The first set of contact points 604A,604B,604C provide a first three-phase current in relation to a first primary-to-secondary phase shift 616,610A, 610B,610C, the second set of contact points 606A,606B, 606C provide a second three-phase current in relation to a second primary-to-secondary phase shift 618, 612A, 612B, 612C, and the third set of contact points 608A, 608B, 608C provide a third three-phase current having a third phase shift 620, 614A,614B,614C. In this embodiment the first primary-to-secondary phase shift 616 is +15°, the second phase shift 618 is 0°, and the third phase shift 620 is −15°. However, the first phase shift 616 may range between 1° and 120°, and the third phase shift 620 may range between −1° and −120°, without departing from the scope of the invention. In alternative embodiments of the invention the primary-to-secondary phase shift angle ranges are changed by using a different secondary winding configuration.

Figure 7:
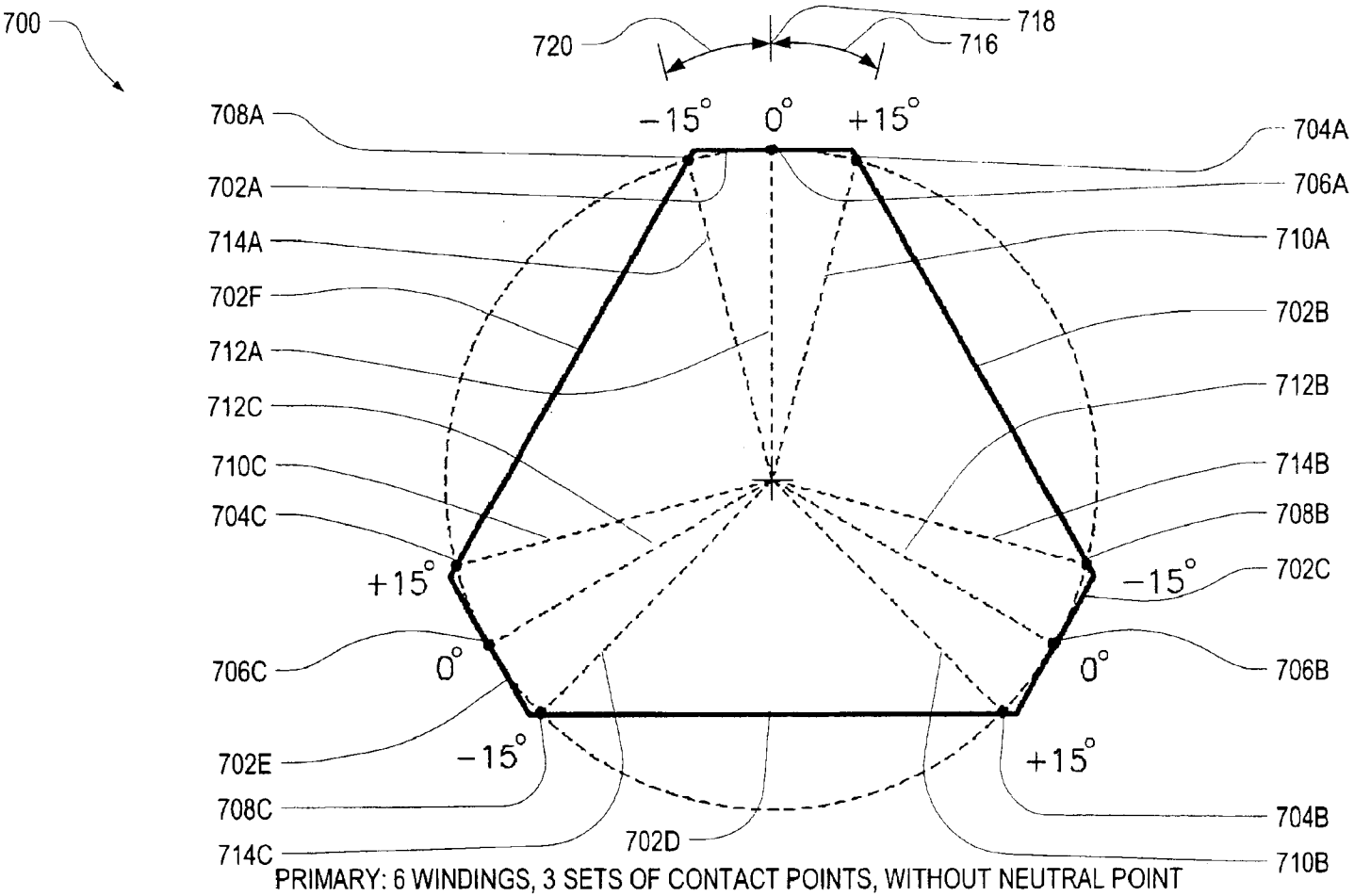

A phasor diagram 700 shown in FIG. 7 illustrates an alternative interconnection of windings in accordance with an embodiment similar to the one shown in FIG. 6. The phasor diagram 700 shows six windings 702A,702B,702C, 702D,702E,702F connected in a closed polygon configuration.

Figure 8:
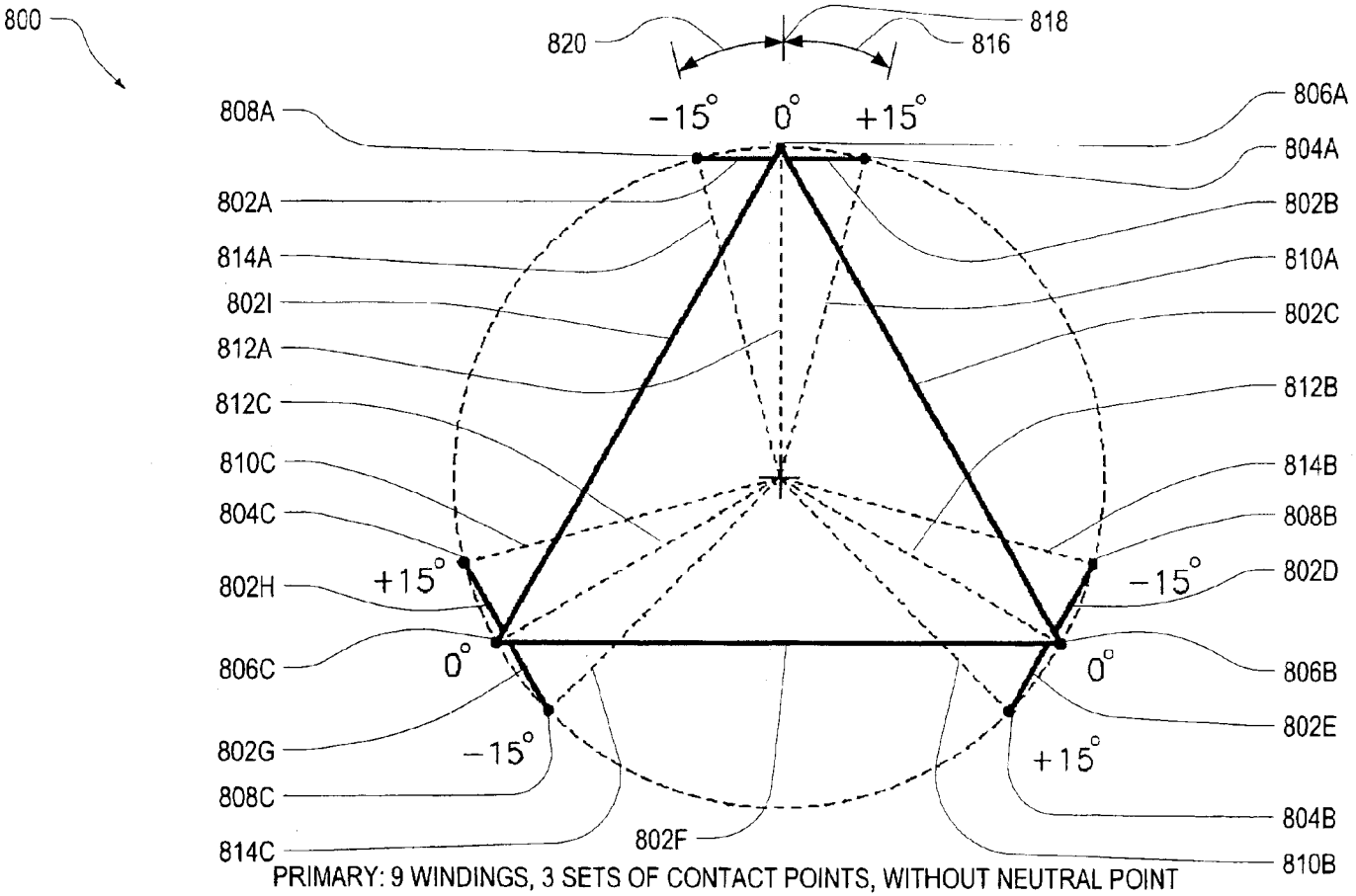

A phasor diagram 800 shown in FIG. 8 illustrates a phase relationship between nine windings 802A,802B,802C, 802D,802E,802F,802G,802H,802I of a primary in accordance with another embodiment of the invention. Of the nine windings 802A,802B,802C,802D,802E,802F,802G,802H, 802I, three windings 802C,802F,802I are connected in a delta configuration, and six windings 802A,802B,802D, 802E,802G,802H are connected as taps to the delta.

Figure 9:
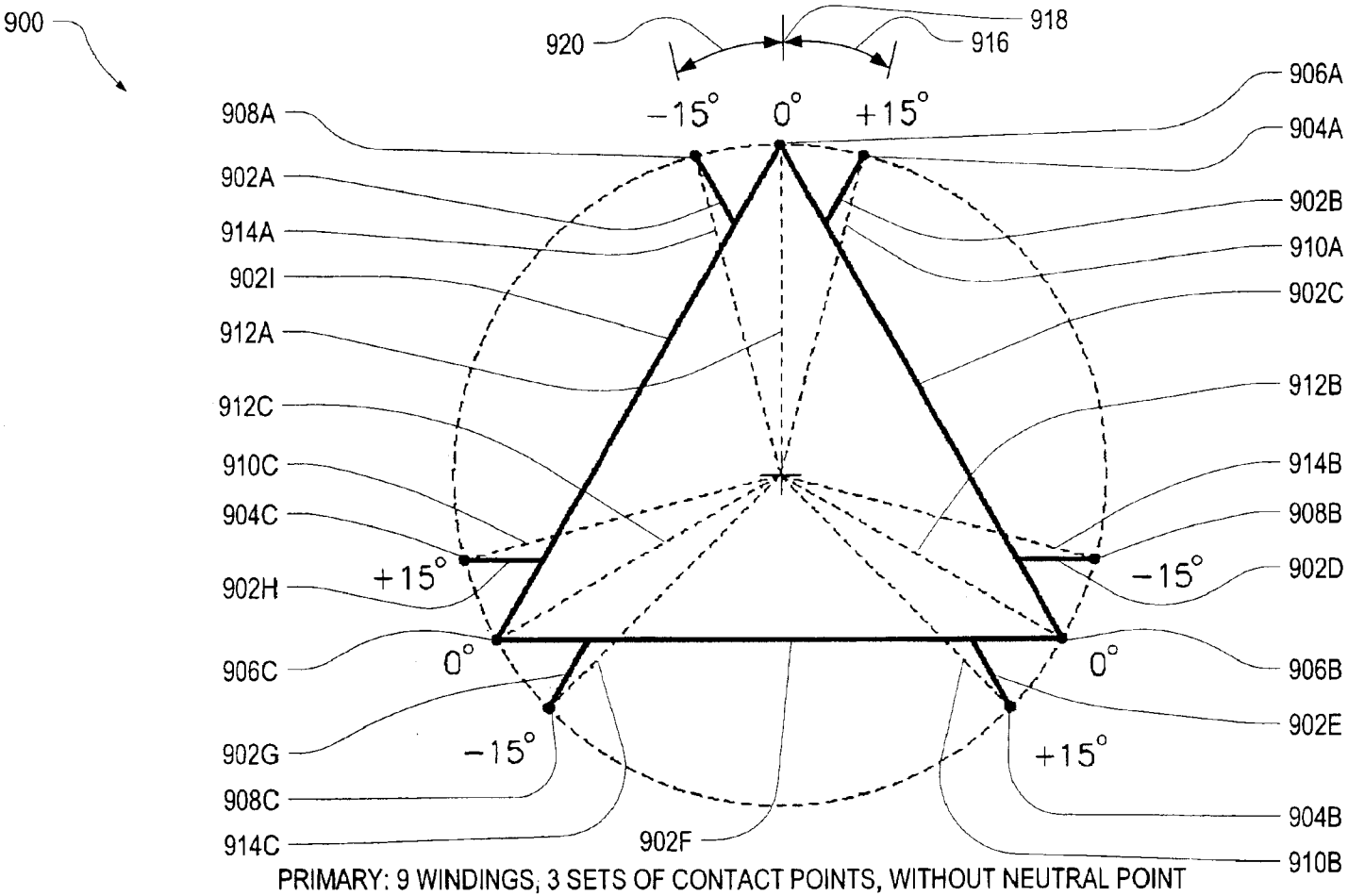

A primary having nine windings 902A, 902B, 902C, 902D, 902E, 902F, 902G, 902H, 902I connected with nine contact points and at six taps in accordance with an alternative embodiment from FIG. 8 is illustrated by the phasor diagram 900 shown in FIG. 9. Again, three windings 902C, 902F, 902I are connected in a delta configuration, and six windings 902A, 902B, 902D, 902E, 902G, 902H are connected as taps to the delta.

Figure 10:
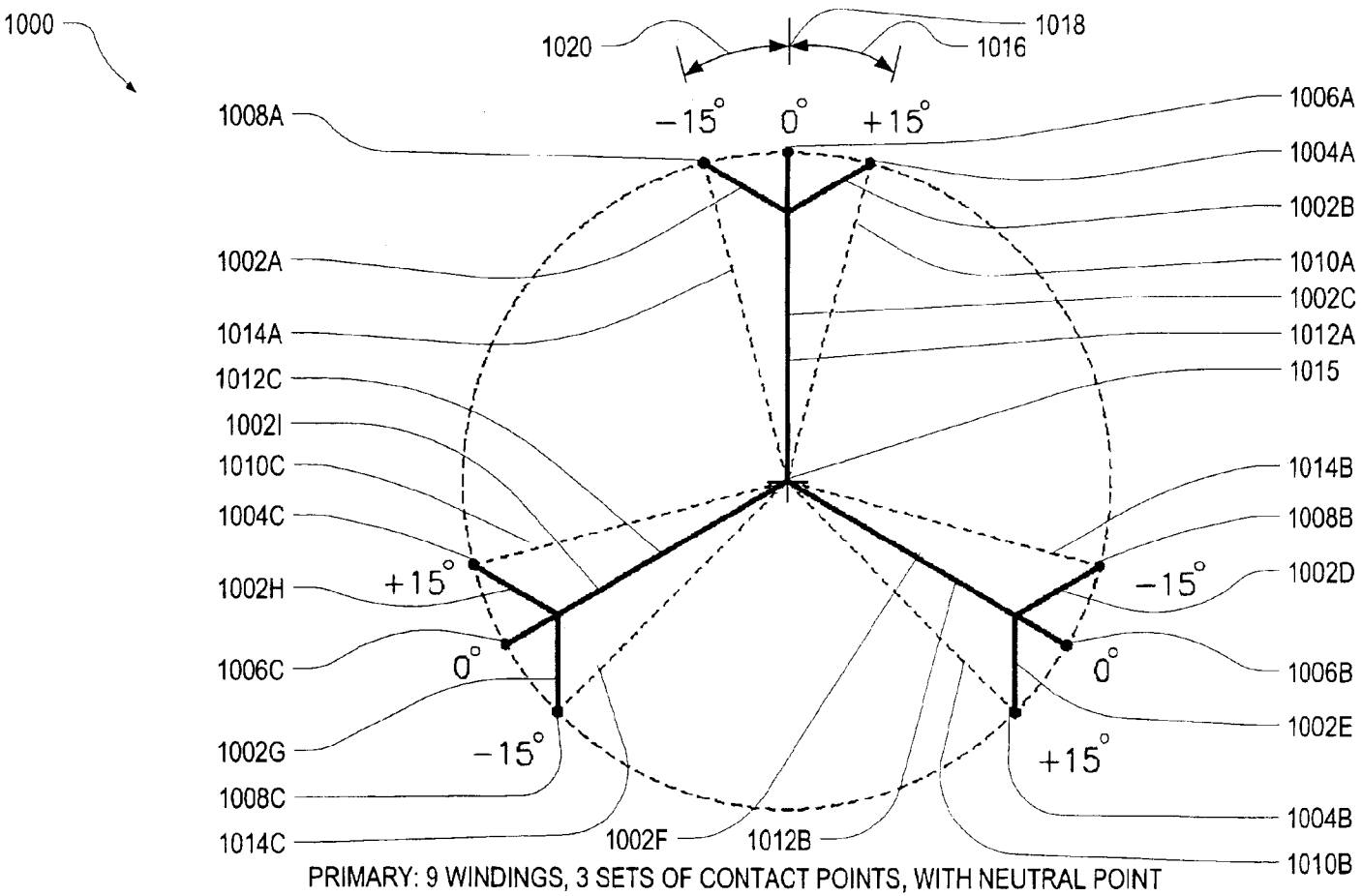
FIGS. 10 and 11 are phasor diagrams of exemplary primaries of a transformer in accordance with the invention.
Figure 11:
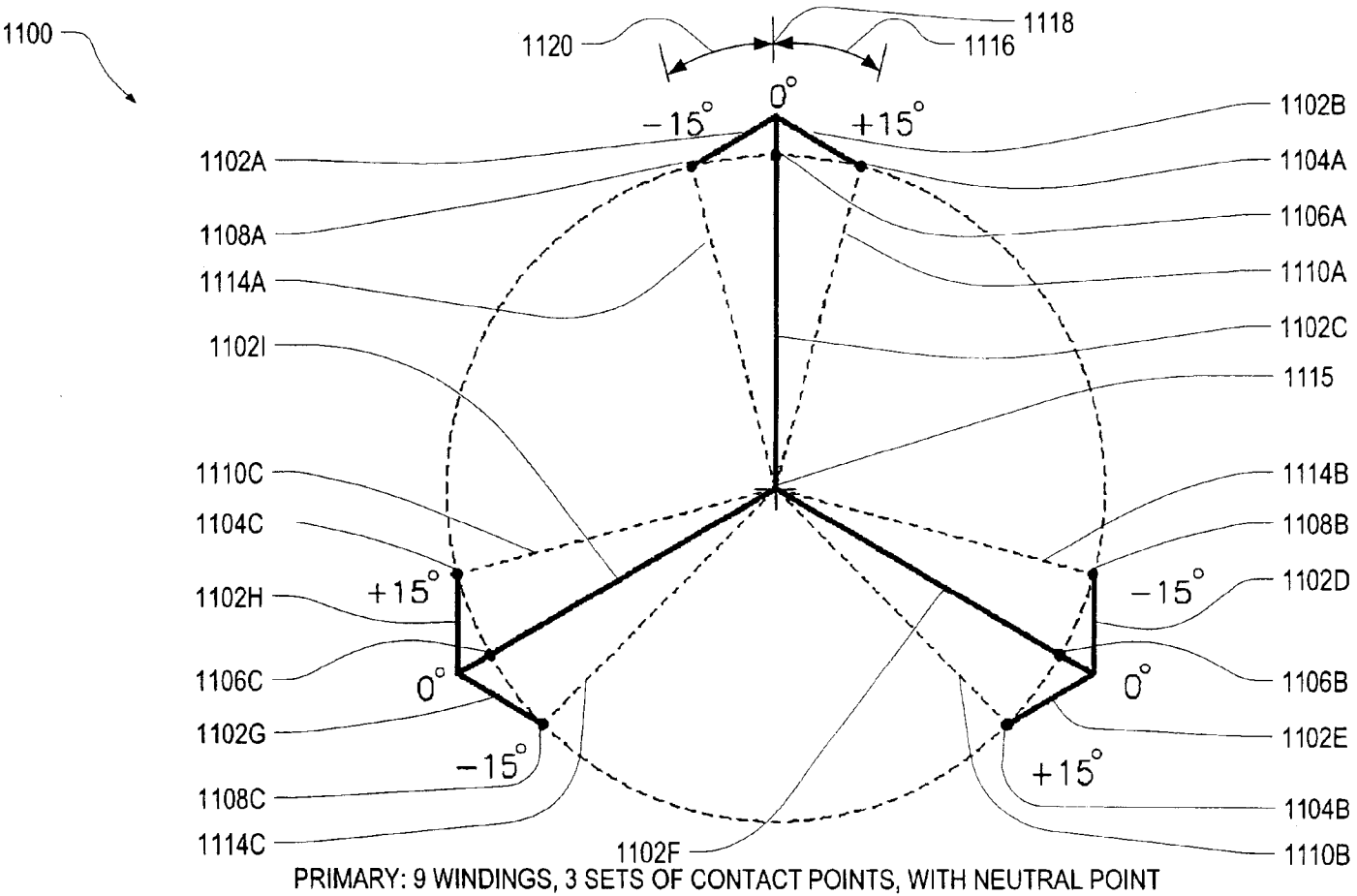

FIGS. 10 and 11 show phasor diagrams 1000,1100 of preferred embodiments of the primary 302A of the first transformer 302 or the primary 304A of the second transformer 304 shown in FIG. 3. That is, a primary corresponding to one of the phasor diagrams 1000,1100 may be used as the primary 302A of the first transformer 302 or the primary 304A of the second transformer 304 or both.

A primary corresponding to the phasor diagram 1000 shown in FIG. 10 has nine windings 1002A,1002B,1002C, 1002D,1002E,1002F,1002G,1002H,1002I, where three windings 1002C,1002F,1002I are connected in a wye configuration and six windings 1002A,1002B,1002D,1002E, 1002G,1002H are connected as taps to the wye, and three sets of contact points: a first set of contact points 1004A, 1004B,1004C (corresponding to the first set of contacts 306A of the primary 302A of the first transformer 302 or to the first set of contacts 308A of the primary 304A of the second transformer 304), a second set of contact points 1006A,1006B,1006C (corresponding to the second set of contacts 306B of the primary 302A of the first transformer 302 or to the second set of contacts 308B of the primary 304A of the second transformer 304), and a third set of contact points 1008A,1008B,1008C (corresponding to the third set of contacts 306C of the primary 302A of the first transformer 302, or to the third set of contacts 308C of the primary 304A of the second transformer 304). A neutral point 1015 is common to all three sets of contact points. The first set of contact points 1004A,1004B,1004C provide a first three-phase current in relation to a first primary-to-secondary phase shift 1016,1010A,1010B,1010C; the second set of contact points 1006A,1006B,1006C provide a second three-phase current in relation to a second primary-to-secondary phase shift 1018,1012A,1012B,1012C, and the third set of contact points 1008A,1008B,1008C provide a third three-phase current in relation to a third primary-to-secondary phase shift 1020,1014A,1014B,1014C. In this embodiment, the first primary-to-secondary phase shift 1016 is +15°, the second primary-to-secondary phase shift 1018 is 0, and the third primary-to-secondary phase shift 1020 is −15° (assuming a particular secondary winding configuration). However, in accordance with the invention, the first primary-to-secondary phase shift 1016 may be in the range of 1° to 120°, and the third primary-to-secondary phase shift 1020 may be in the range of −1° to −120°.

A phasor diagram 1100 shown in FIG. 11 illustrates a primary having three alternative sets of contacts in the same fixed relation to the same assumed secondary as that of FIG. 10. Like the primary of FIG. 10, the primary of FIG. 11 has nine windings 1102A,1102B,1102C,1102D,1102E,1102F, 1102G,1102H,1102I, where six windings 1102A,1102B, 1102D,1102E,1102G,1102H are connected by taps to a wye formed by the remaining three. Phasor diagram 1100 provides an alternative configuration for a primary having the prescribed sets of contacts.

Figure 12A:
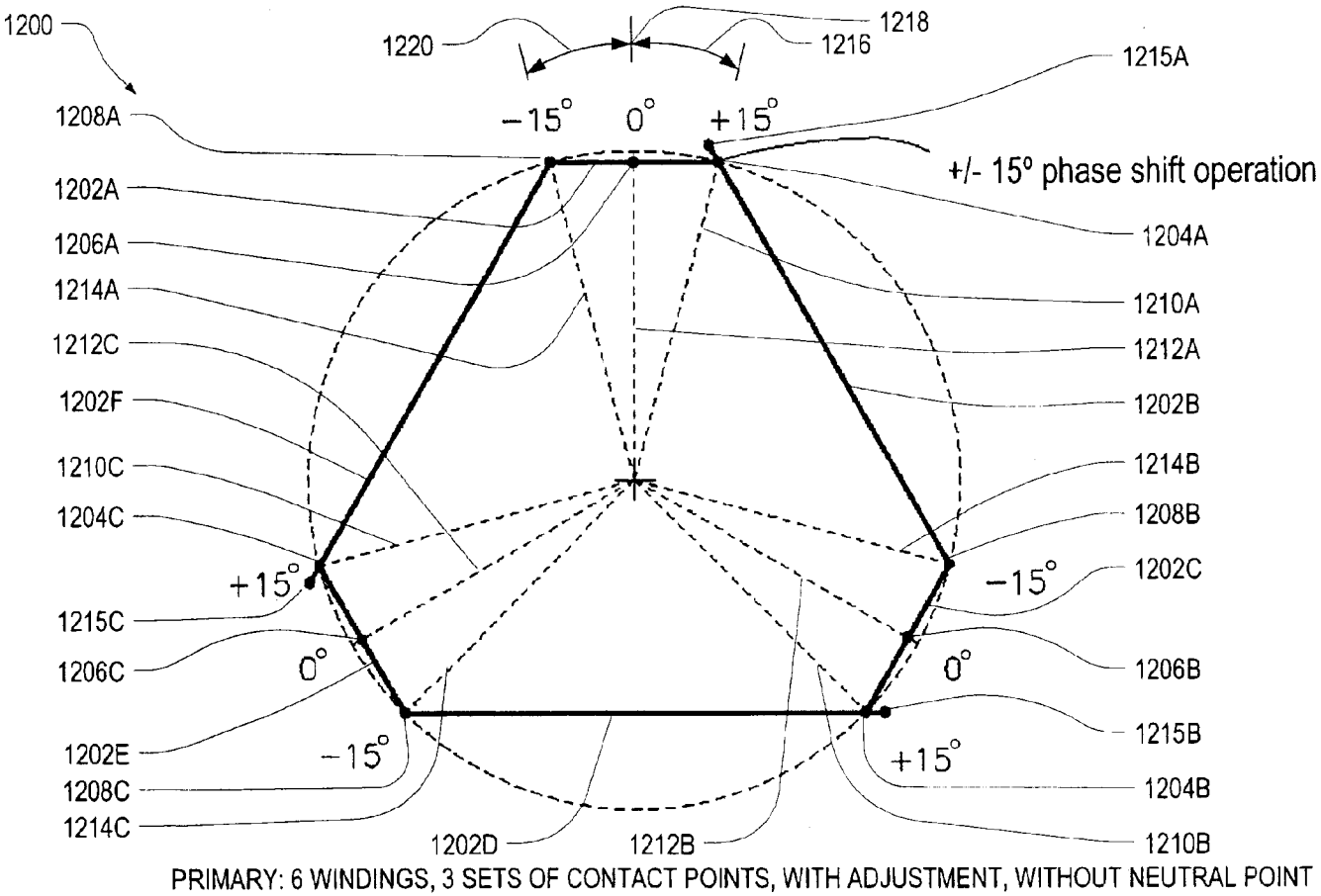
FIGS. 12A and 12B are phasor diagrams of another exemplary primary of a transformer in accordance with the invention.
Figure 12B:
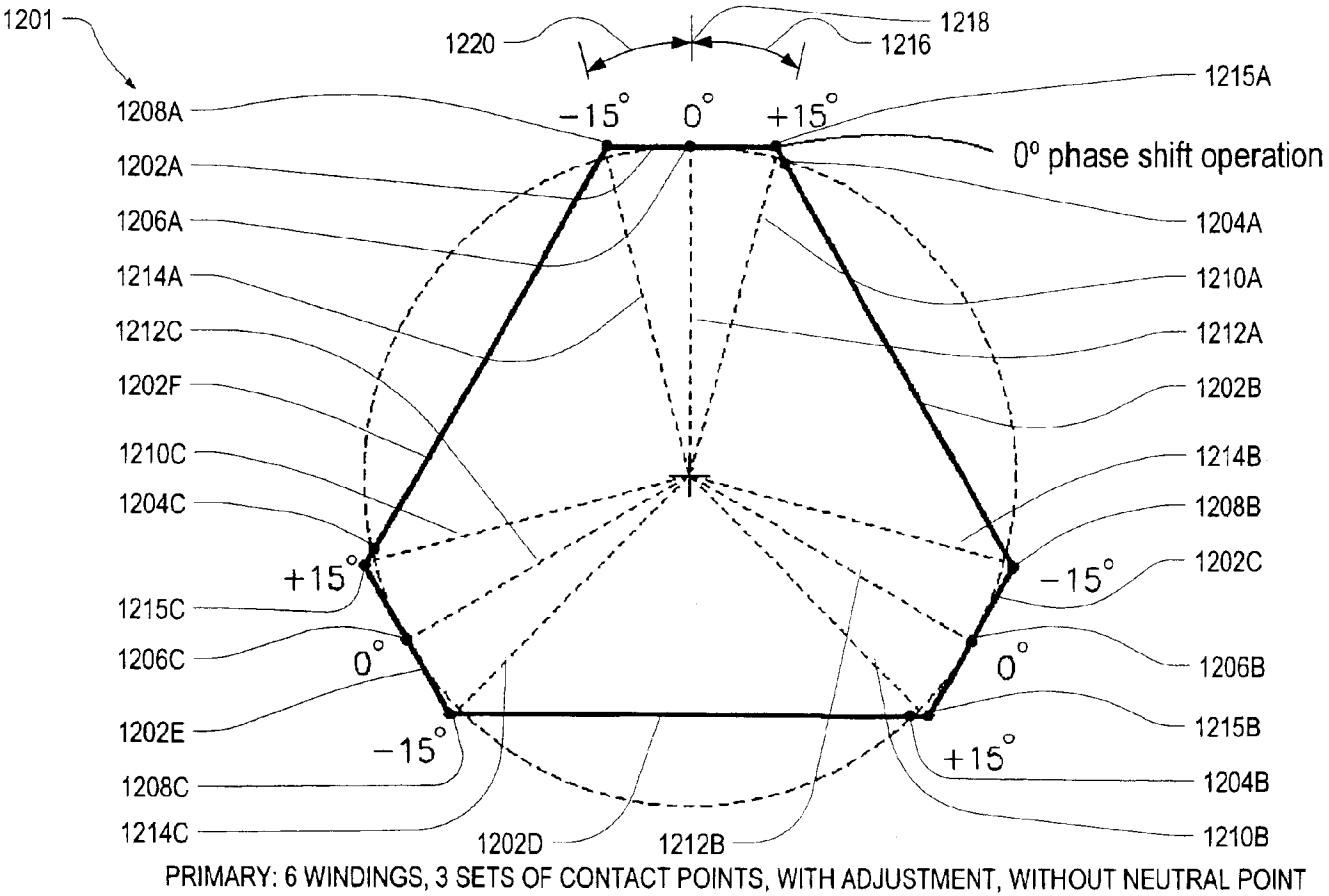

A primary corresponding to the phasor diagrams 1200, 1201 shown in FIGS. 12A and 12B provides three sets of contacts (1204A,1204B,1204C,1206A,1206B,1206C, 1208A,1208B,1208C), and three voltage adjustment taps 1215A,1215B,1215C. FIG. 12A shows connectivity with the voltage adjustment taps 1215A, 1215B, 1215C not used in association with a first mode for either of +/−15° of primary-to-secondary phase shift operation, when the power source is supplied to contacts 1204A,1204B,1204C, or 1208A, 1208B,1208C. FIG. 12B shows connectivity with voltage adjustment taps 1215A,1215B,1215C near the ends of the windings 1202B,1202D,1202F in accordance with a second mode, to provide 0° primary-to-secondary phase shift operation when the power source is supplied to contacts 1206A, 1206B,1206C.

Figure 13A:
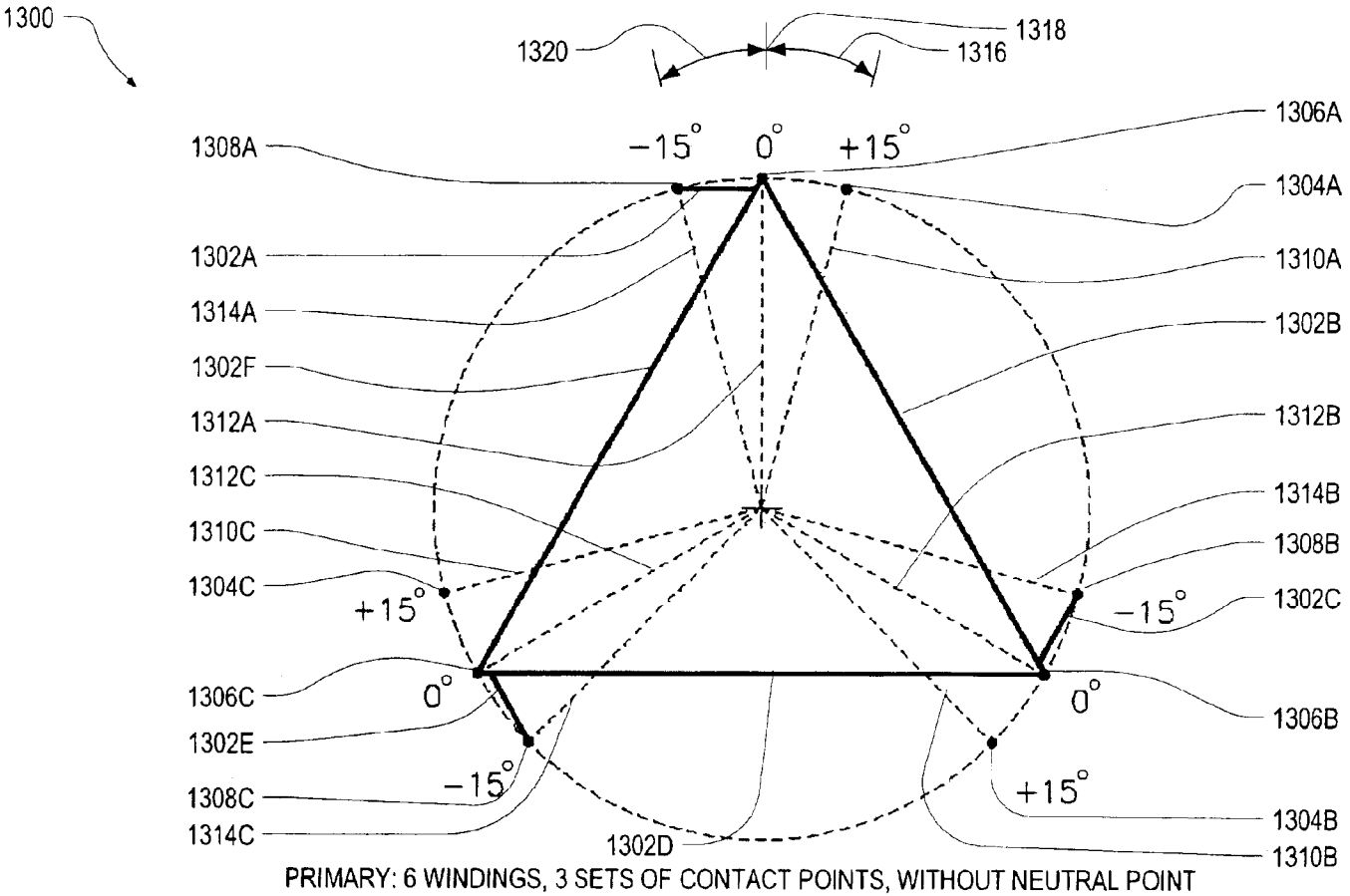
FIGS. 13A and 13B are phasor diagrams of still another exemplary primary of a transformer in accordance with the invention.
Figure 13B:
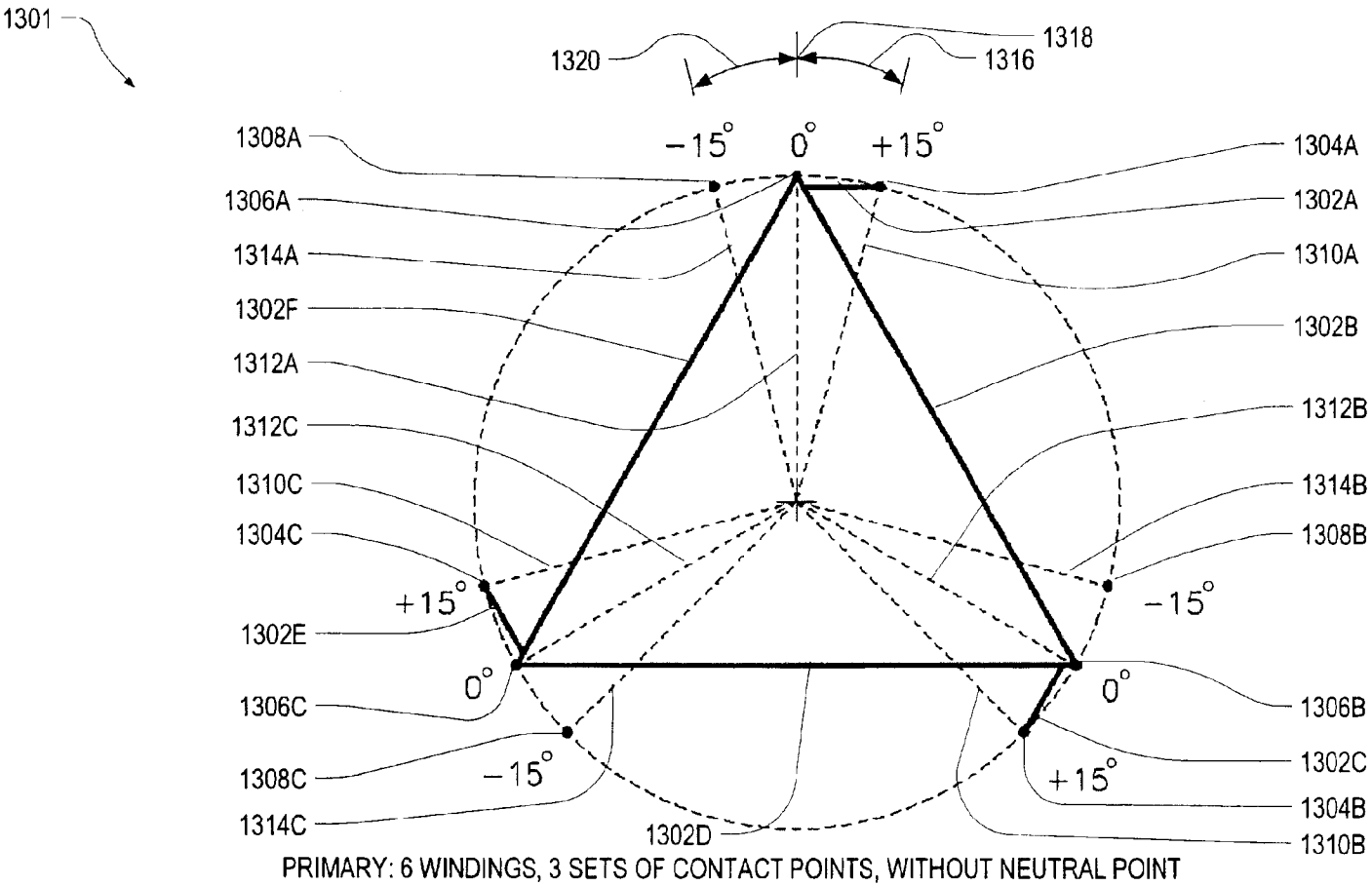

A primary corresponding to the phasor diagrams 1300, 1301 shown in FIGS. 13A and 13B provides the same contacts relative to a given secondary as those corresponding to the phasor diagram 800 shown in FIG. 8, except that it has six windings 1302A,1302B,1302C,1302D,1302E, 1302F, instead of nine. Three of the six windings 1302B, 1302D,1302F, are connected to form a delta. A first winding 1302A, a third winding 1302C, and a fifth winding 1302E are field re-connectable windings. As will be apparent by inspection, the first winding 1302A, third winding 1302C, and fifth winding 1302E are parallel to, and therefore are wound on a same winding leg as the windings of 1302D, 1302F, and 1302B, respectively. FIG. 13A shows the re-connectable windings 1302A,1302C,1302E configured for −15° and FIG. 13B shows the re-connectable windings 1302A,1302C,1302E configured for +15° operation connected to different respective taps on respective windings that form the delta.

Figure 14A:
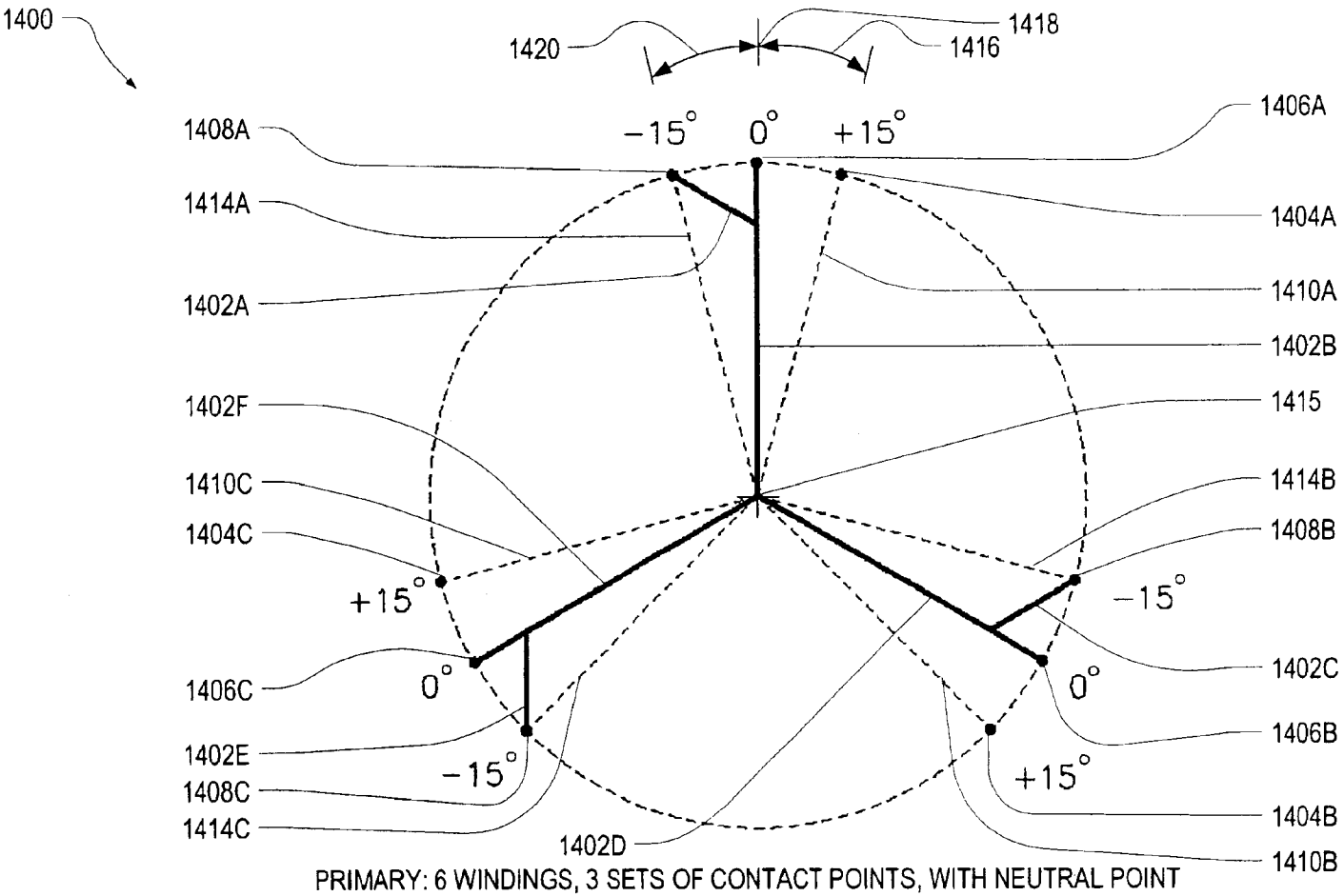
FIGS. 14A and 14B are phasor diagrams of another exemplary primary of a transformer in accordance with the invention.
Figure 14B:
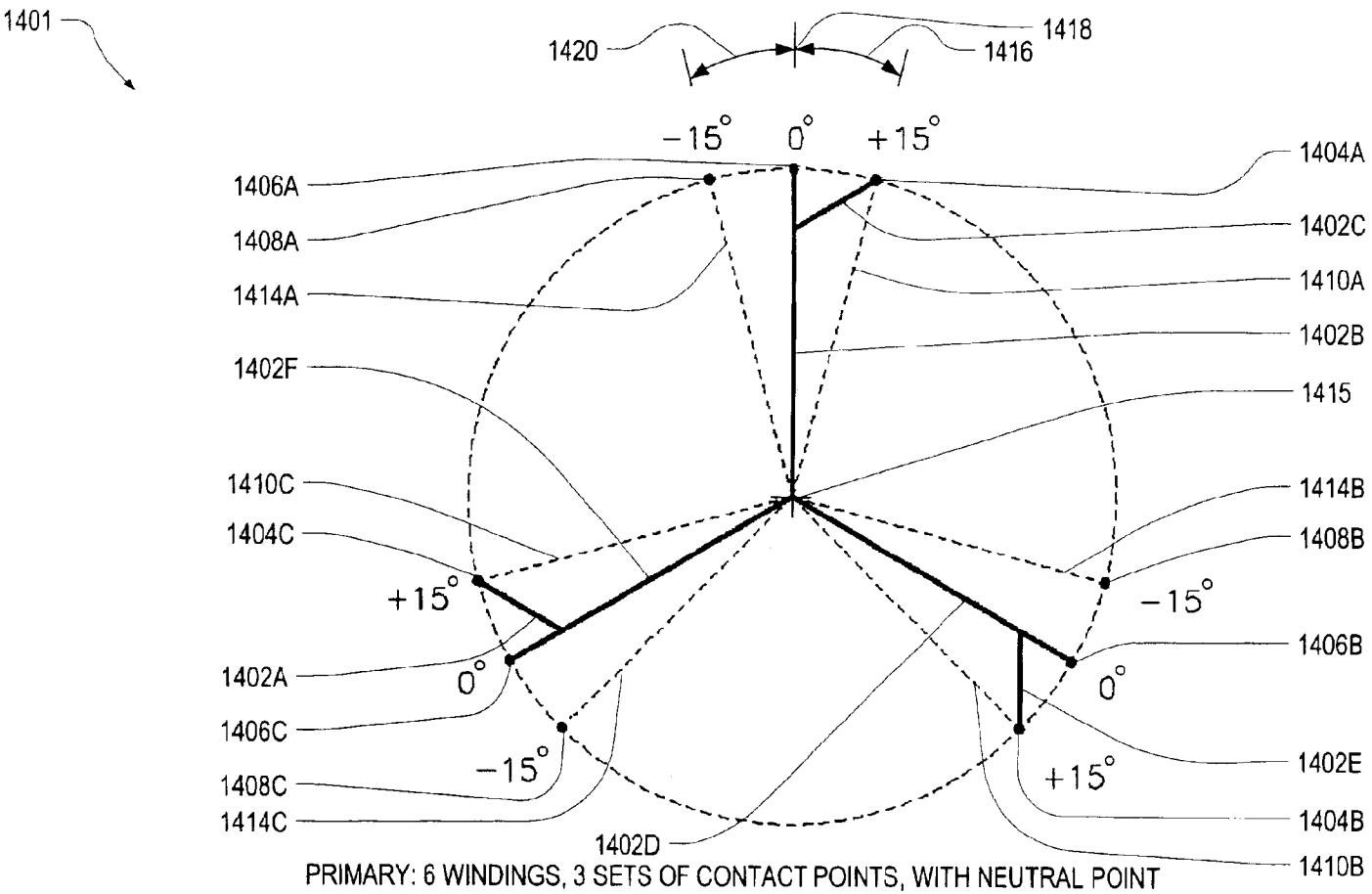

A primary corresponding to the phasor diagrams 1400, 1401 shown in FIGS. 14A and 14B provides the same contacts relative to a given secondary as those corresponding to the phasor diagram 1000 shown in FIG. 10, except that it has six windings 1402A,1402B,1402C,1402D,1402E, 1402F. Three of the six windings 1402B,1402D,1402F are connected in a wye configurations, and the other three windings 1402A,1402C,1402E, are connected to taps on respective windings 1402B, 1402D,1402F that form the wye configuration. A first winding 1402A, a third winding 1402C, and a fifth winding 1402E are field re-connectable windings. FIG. 14A shows the re-connectable windings 1402A,1402C,1402E configured for −15° and FIG. 14B shows the re-connectable windings 1402A,1402C,1402E configured for +15° operation.

Figure 15A:
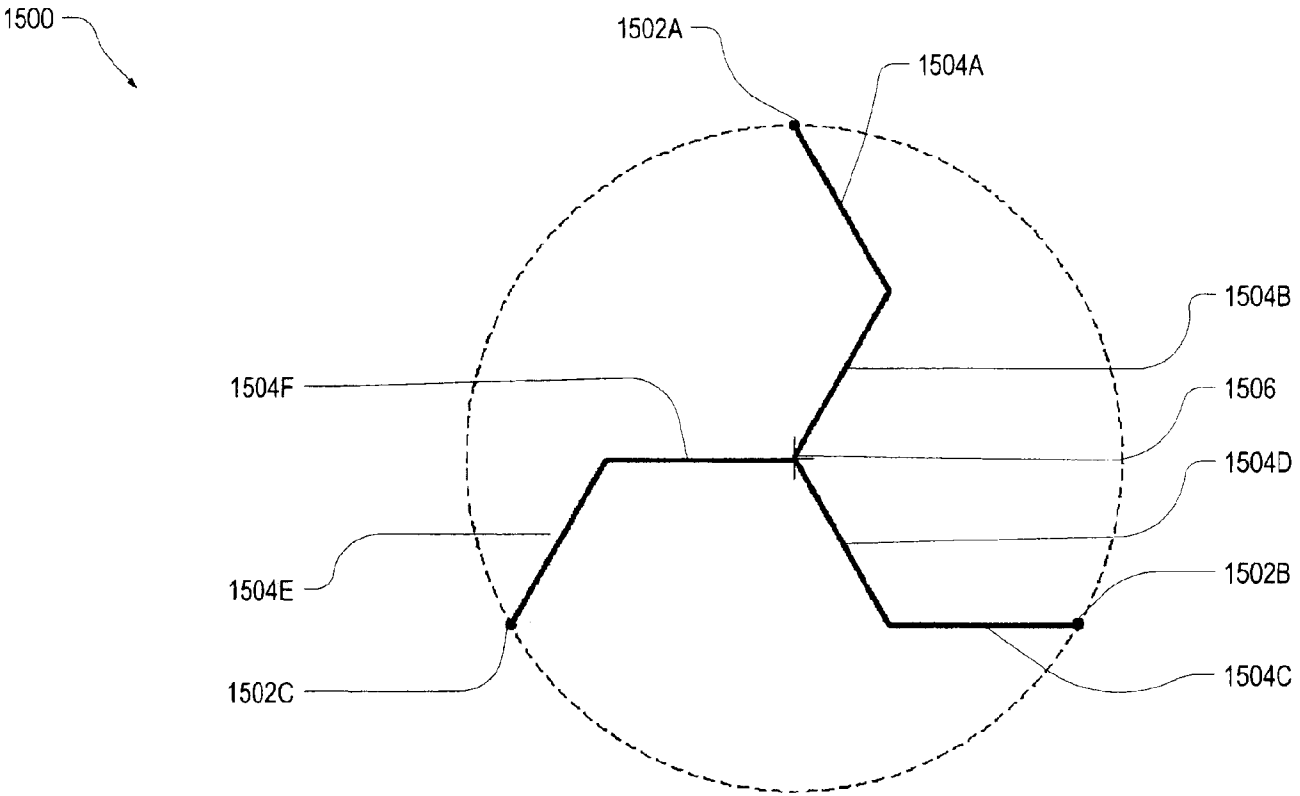
FIGS. 15A and 15B and 16 are phasor diagrams of respective exemplary secondaries of transformers in accordance with the invention.

FIG. 15A shows a phasor diagram 1500 of a preferred embodiment of a secondary, preferably used in any of the secondaries 102B,104B,202B,204B,302B,304B shown in FIGS. 1 to 3. The secondary has six windings 1504A, 1504B,1504C,1504D,1504E,1504F connected in a wye-connected zig-zag configuration, one set of contact points 1502A,1502B,1502C, and a neutral point 1506 common to all of these contact points.

Figure 15B:
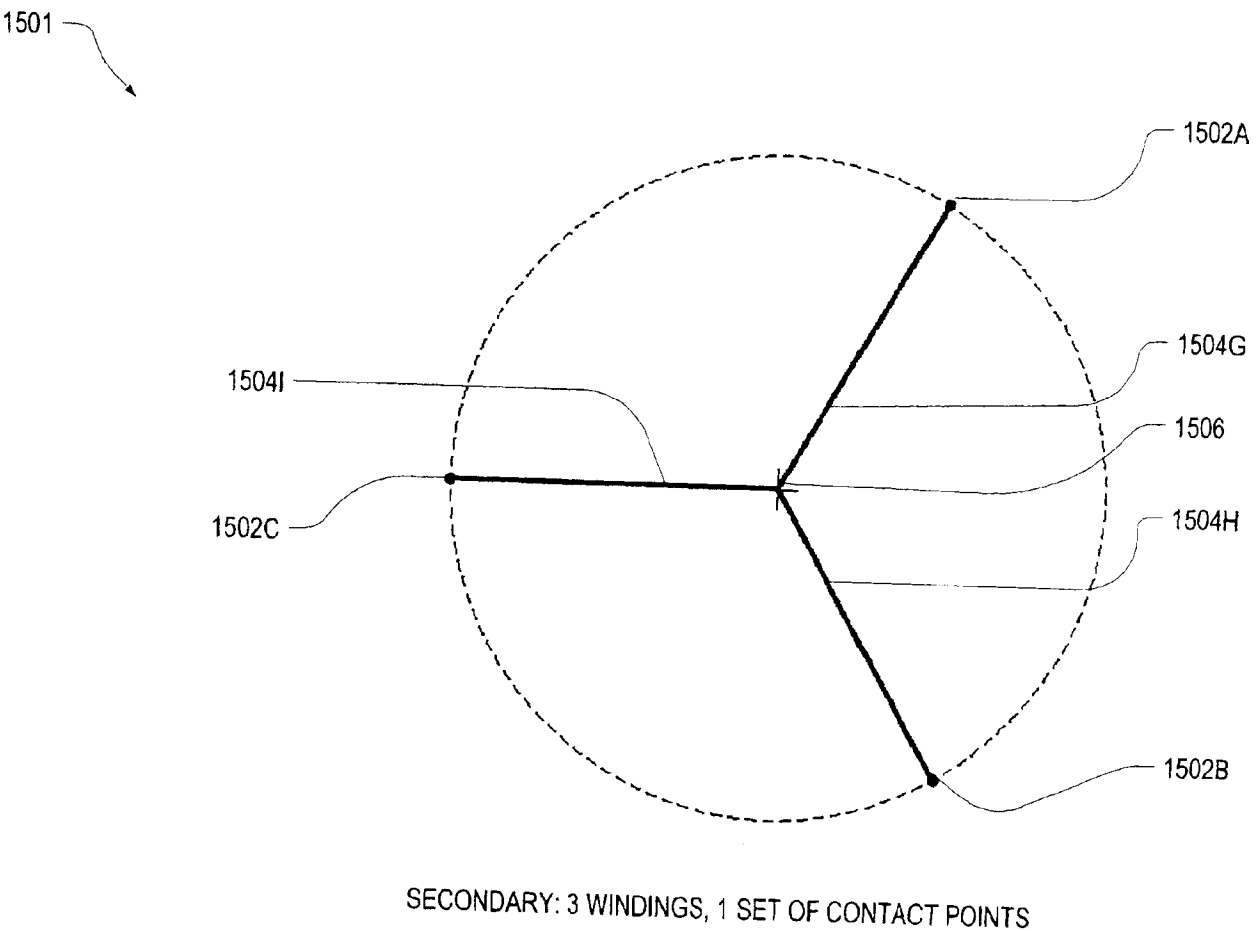

FIG. 15B shows a phasor diagram 1501 of an embodiment of a secondary used alternative to the secondary illustrated with respect to the phasor diagram 1500, that may be deployed in any of the secondaries 102B, 104B, 202B, 204B, 302B, 304B shown in FIGS. 1–3. The secondary has three windings 1504G, 1504H, 1504I, connected in a wye configuration at a neutral point 1506. One set of contact points 1502A,1502B,1502B,1502C.

Figure 16:
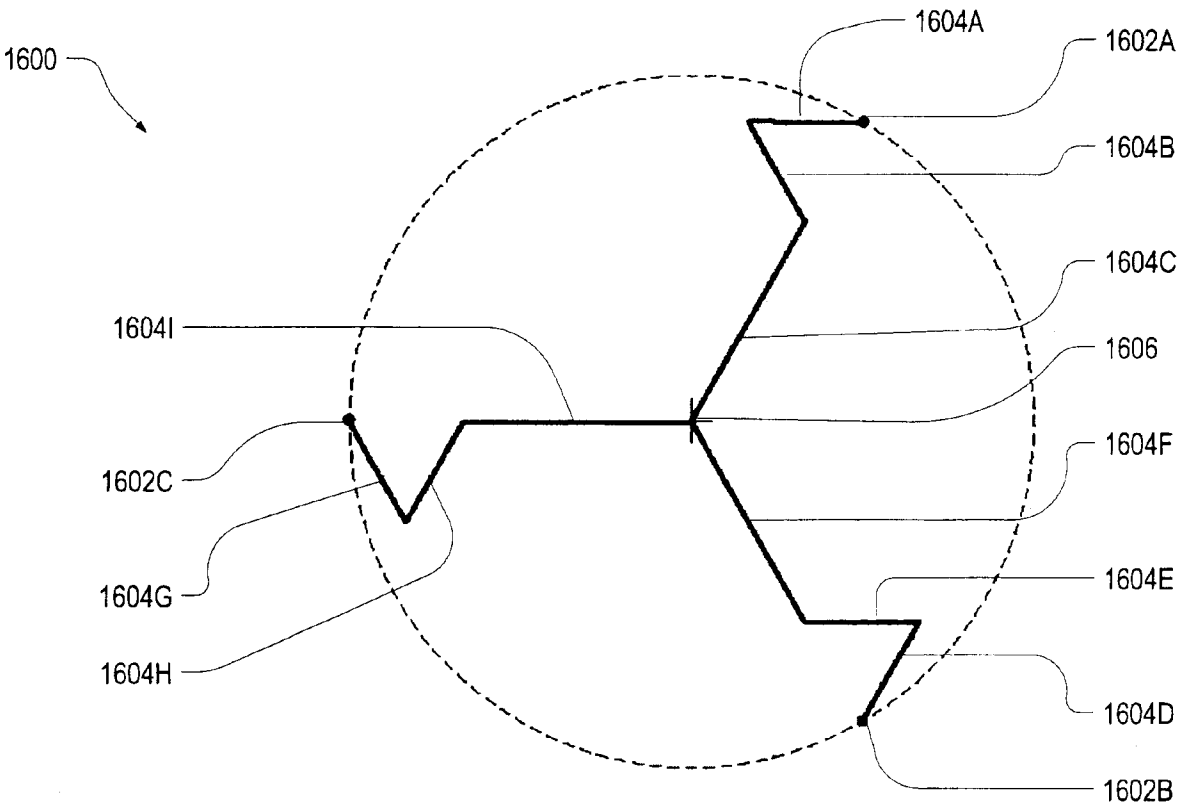

FIG. 16 shows a phasor diagram 1600 of another embodiment of a secondary, that may be used with any of the secondaries 102B,104B,202B,204B,302B,304B shown in FIGS. 1–3. The other secondary has nine windings 1604A, 1604B,1604C,1604D,1604E,1604F,1604G,1604H,1604I, in a wye-connected zig-zag configuration at a neutral point 1606. One set of contact points 1602A,1602B,1602C is provided.

Figure 17A:
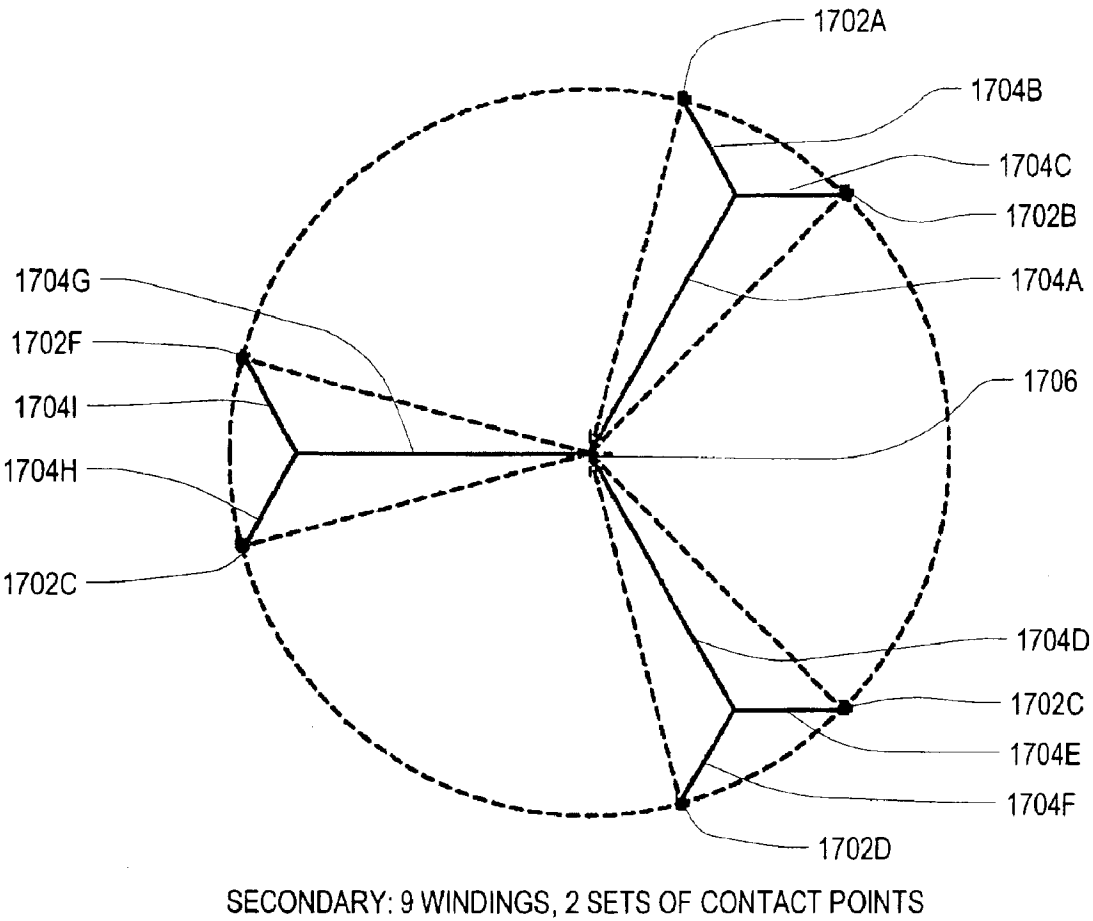
FIGS. 17A, 17B, 17C and 17D are phasor diagrams of respective exemplary secondaries of transformers having multiple sets of contact points, in accordance with the invention.

Four secondary winding configurations 1700,1701,1702, 1703 are illustrated respectively in FIGS. 17A, 17B, 17C, and 17D, which are zig-zag-wye-connected. Each of these secondary winding configurations includes a plurality of sets of contact points, to provide respective primary-to-secondary phase offsets. As will be appreciated by those of skill in the art, if a secondary has multiple sets of contact points, and the primary has multiple sets of contact points, the total number of primary-to-secondary phase shifts will be the product of the two. Of course, each pair of sets of contacts on the primary and sets of contacts on the secondary may not yield distinct primary-to-secondary phase shifts, in all embodiments. These secondary winding configurations 1700,1701,1702,1703 may be used alternatively to that of phasor diagram 1500, shown in FIG. 15A, in which case the plurality of loads may be distributed and connected among the plurality of contact points FIG. 17A is a phasor diagram 1700 of a secondary providing two sets of contact points 1702A,1702C,1702E, and 1702B,1702D,1702F provided at ends of six of nine windings 1704B,1704C,1704E,1704F,1704H,1704I. Three of the nine windings 1704A,1704D,1704G, are interconnected in a wye configuration at a neutral point 1706.

Figure 17B:
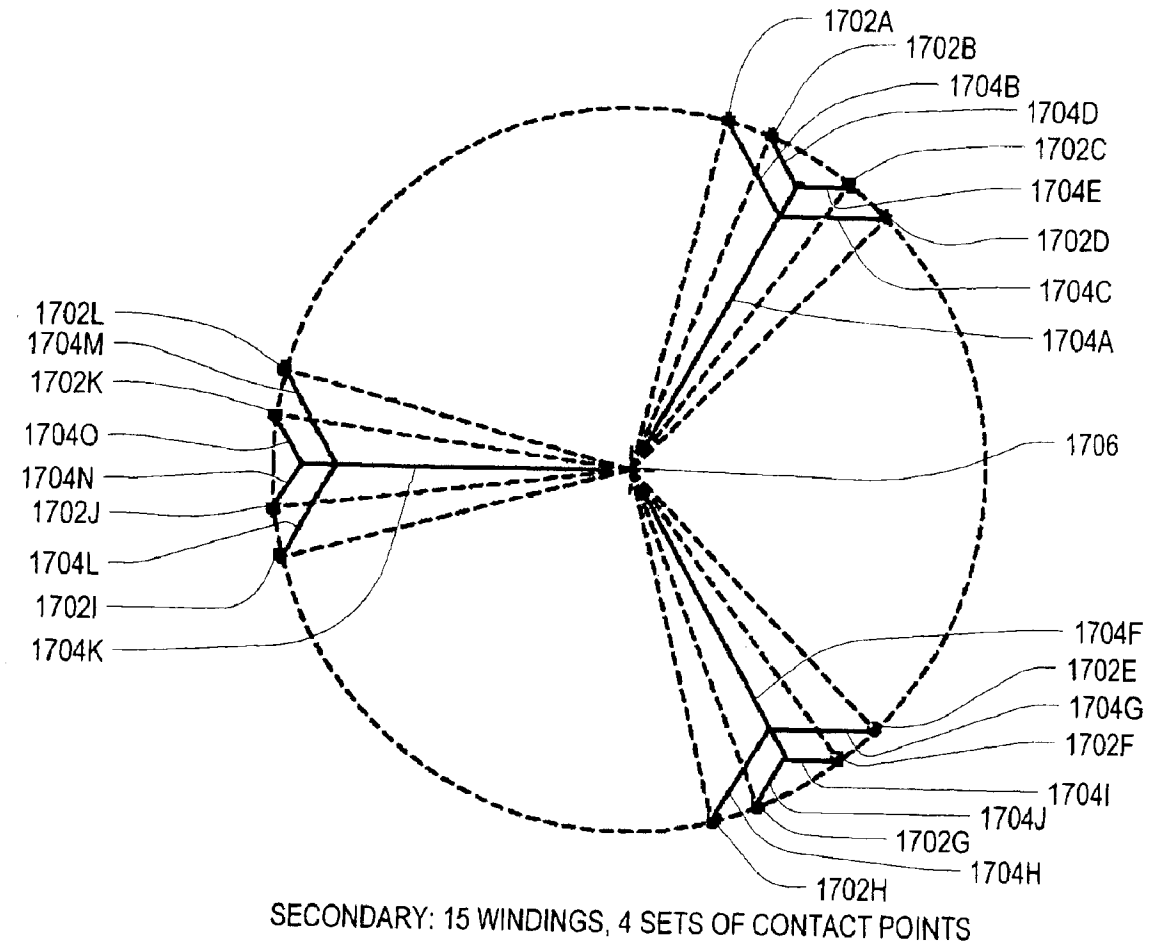

FIG. 17B is a phasor diagram 1701 of a secondary providing four sets of contact points 1702A,1702E,1702I; 1702B,1702F,1702J,1702C,1702G,1702K; and 1702D, 1702H,1702L. Two of the sets of contact points 1702B, 1702F,1702J; and 1702C,1702G,1702K are provided at ends of 6 of 15 windings 1704D,1704E,1704I,1704J,1704N, 1704O, which are connected to respective ends of three of the nine windings 1704A,1704F,1704K, that are interconnected in a wye configuration. The other two sets of contact points 1702A,1702E,1702I; and 1702D,1702H,1702L, are tapped to the respective ones of the wye-connected three of the nine windings 1704A,1704F,1704K. More specifically, contact points 1702A,1702E,1702I, and 1702D,1702H, 1702L, are provided at ends of windings respectively at 1704B,1704G,1704L, and 1704C,1704H,1704M. The three of the nine windings 1704A,1704F,1704K, are interconnected in the wye configuration at a neutral point 1706.

Figure 17C:
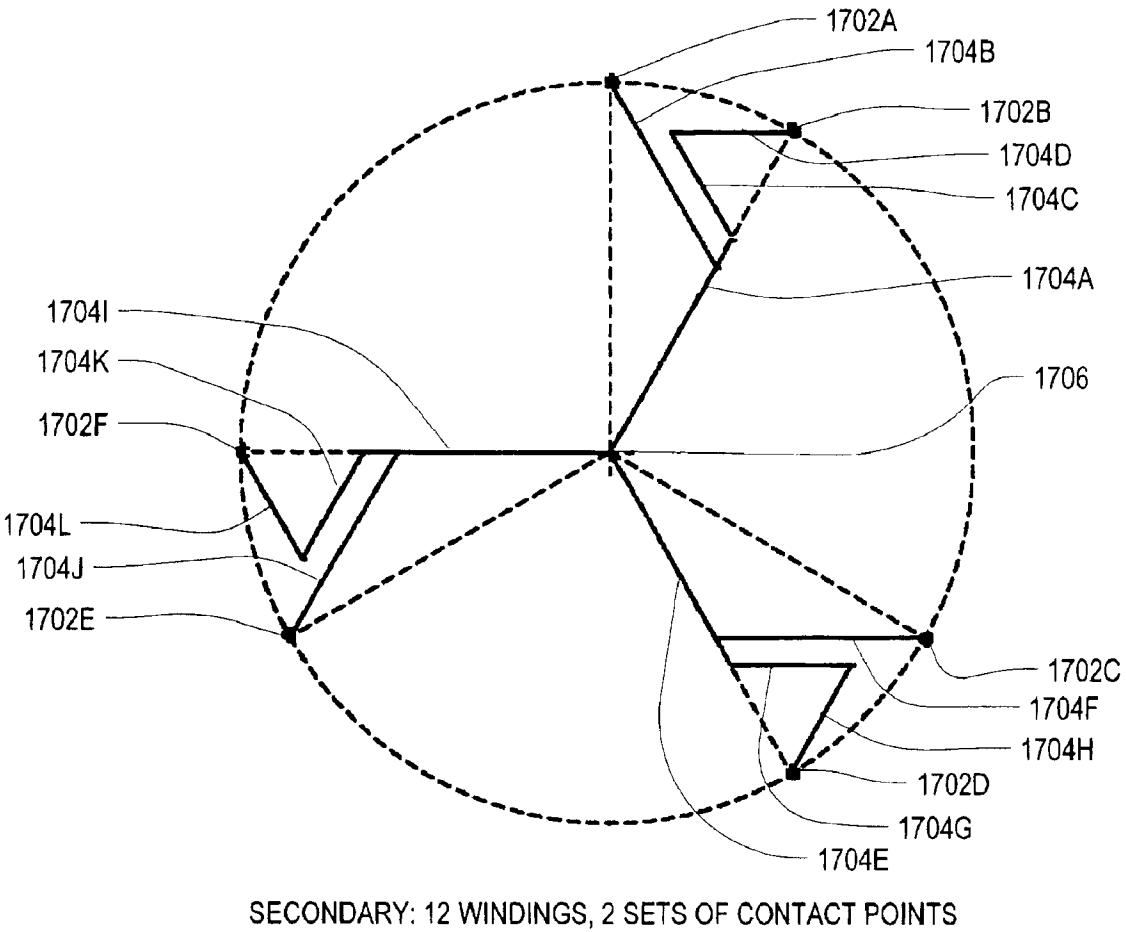

FIG. 17C is a phasor diagram 1702 of a secondary providing two sets of contact points 1702A,1702C,1702E; and 1702B,1702D,1702F. One of the sets of contact points 1702A,1702C,1702E are provided at respective ends of 3 of 12 windings 1704B,1704F,1704J, which are tapped to respective ends of three of the nine windings 1704A,1704E, 1704I, that are interconnected in a wye configuration. The other set of contact points 1702B,1702D, 1702F provided at end connections to the respective windings 1704D,1704H, 1704L, which are end connected respectively to the respective windings 1704C,1704G,1704K, that are, in turn, end connected to the wye-connected three of the nine windings 1704A,1704E,1704I. The three of the nine windings 1704A, 1704E,1704I, are interconnected in the wye configuration at the neutral point 1706.

Figure 17D:
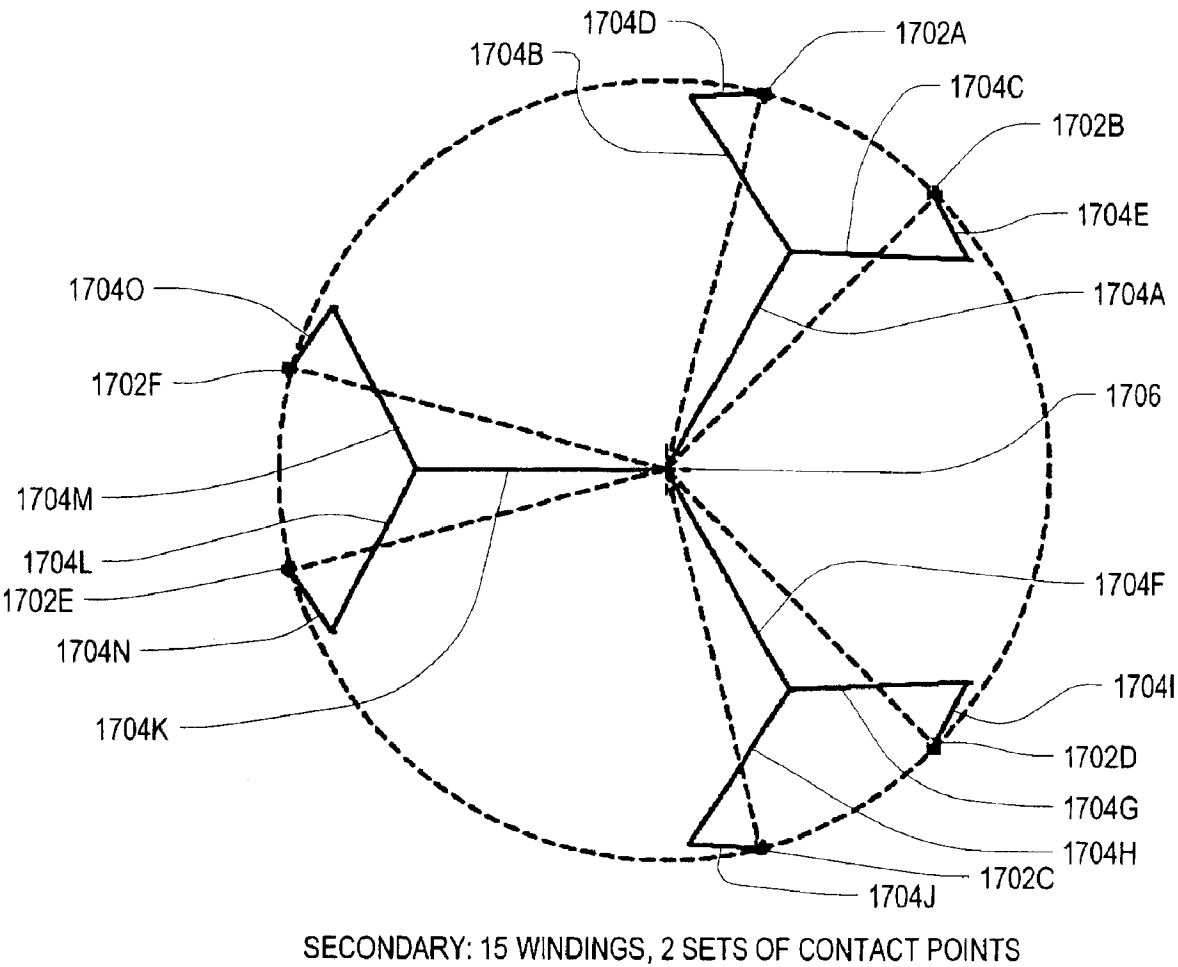

FIG. 17D is a phasor diagram 1703 of a secondary providing two sets of contact points 1702A,1702C,1702E, and 1702B,1702D,1702F interconnected by 15 windings 1704A,1704B,1704C, 1704D, 1704E, 1704F, 1704G, 1704H,1704I,1704J, 1704K,1704L,1704M,1704N,1704O. One of the sets of contact points 1702A,1702C,1702E, are provided at end connections to the respective windings 1704D,1704I,1704N. The windings 1704D,1704I,1704N are end connected respectively to the windings 1704B, 1704G,1704L, that are, in turn, end connected to three windings 1704A,1704F,1704K that are wye connected. The other of the sets of contact points 1702B,1702D,1702F, are provided at end connections to the respective windings 1704E,1704J,1704O, which are end connected respectively to the respective windings 1704C,1704H,1704M, that are, in turn, end connected to the wye-connected three windings 1704A,1704F,1704K. The three windings 1704A,1704F, 1704K, are interconnected in the wye configuration at the neutral point 1706.

Figure 18:
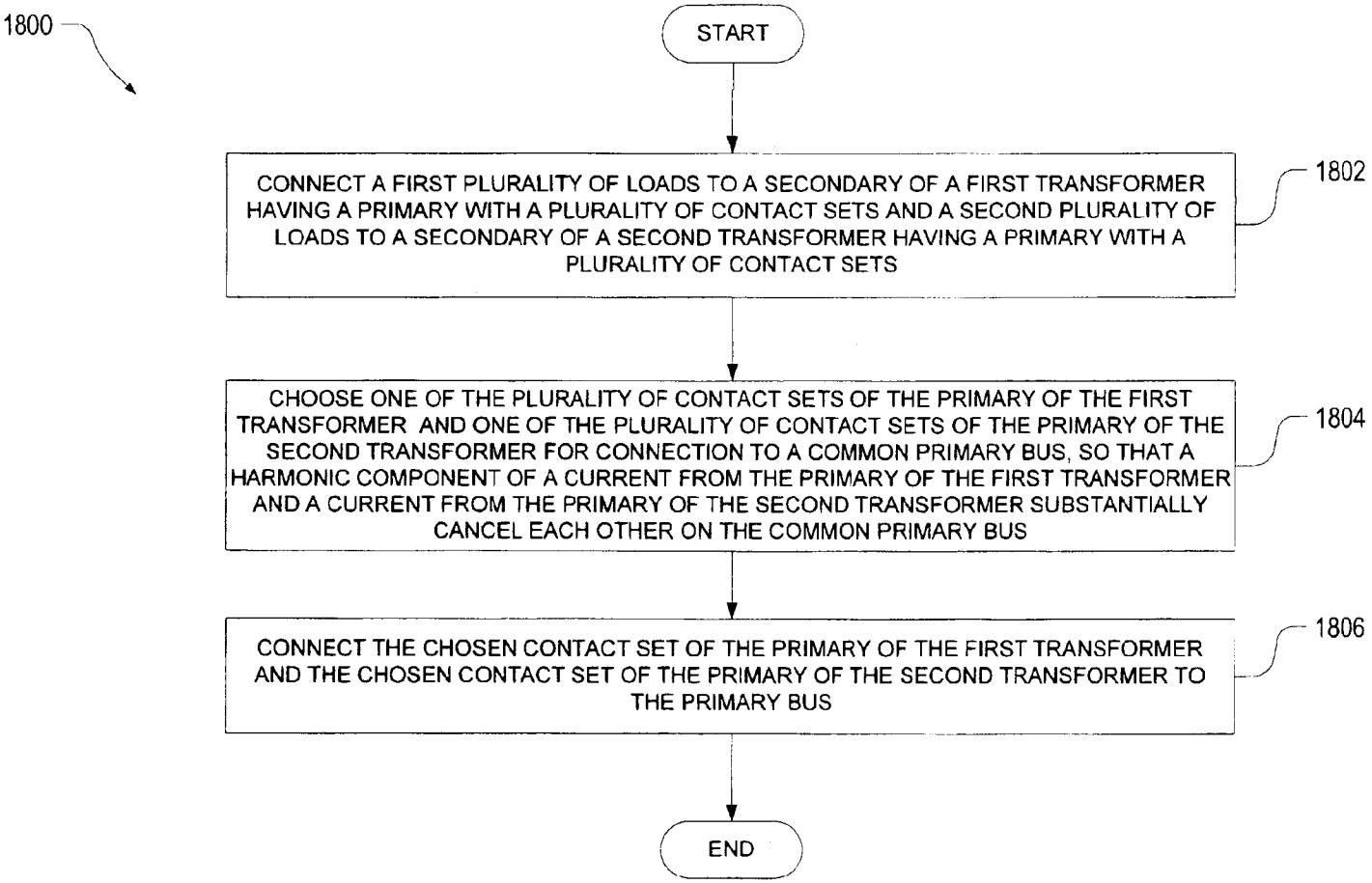
FIGS. 18, 19 and 20 are flow charts of methods in accordance with the invention.

FIG. 18 is a flowchart 1800 of a method for connecting a field-adjustable phase shifting transformer within a three-phase AC power distribution system in accordance with the invention. The method includes a first step of connecting a first plurality of loads 116 to a secondary 102B of a first transformer 102 having a primary 102A with a plurality of contact sets 106 and connecting a second plurality of loads 126 to a secondary 104B of a second transformer 104 having a primary 104A with a plurality of contact sets 108 (step 1802). In a second step one of the pluralities of contact sets 106B of the primary 104A of the first transformer 102, and one of the pluralities of contact sets 108A of the primary 104A of the second transformer 104 is chosen for connection to a common primary bus 112. The choice of the contact sets is made to substantially cancel an identified harmonic component of a current in the primary 102A of the first transformer 102 and a current in the primary 104A of the second transformer 104 on the common primary bus 112 (step 1804). The chosen sets are then interconnected with the common primary bus 112. In a last step, the chosen contact set 106B of the primary 102A of the first transformer 102, and the chosen contact set 108A of the primary 104A of the second transformer 104 are connected to the primary bus 112 (step 1806). It will be understood by those skilled in the art that steps 1802–1806 can be performed in a different order than the order described above. While the invention has been described with respect to the pair of transformers illustrated in FIG. 1, the same method applies equally to any other embodiment of the invention. It is furthermore well known in the art to couple a plurality of secondaries to a single primary, to otherwise achieve the same mitigation of harmonics.

The invention therefore provides a phase shifting transformer for canceling harmonic currents in a three-phase AC power distribution system that is facilitates construction and is field-adjustable.

Figure 19:
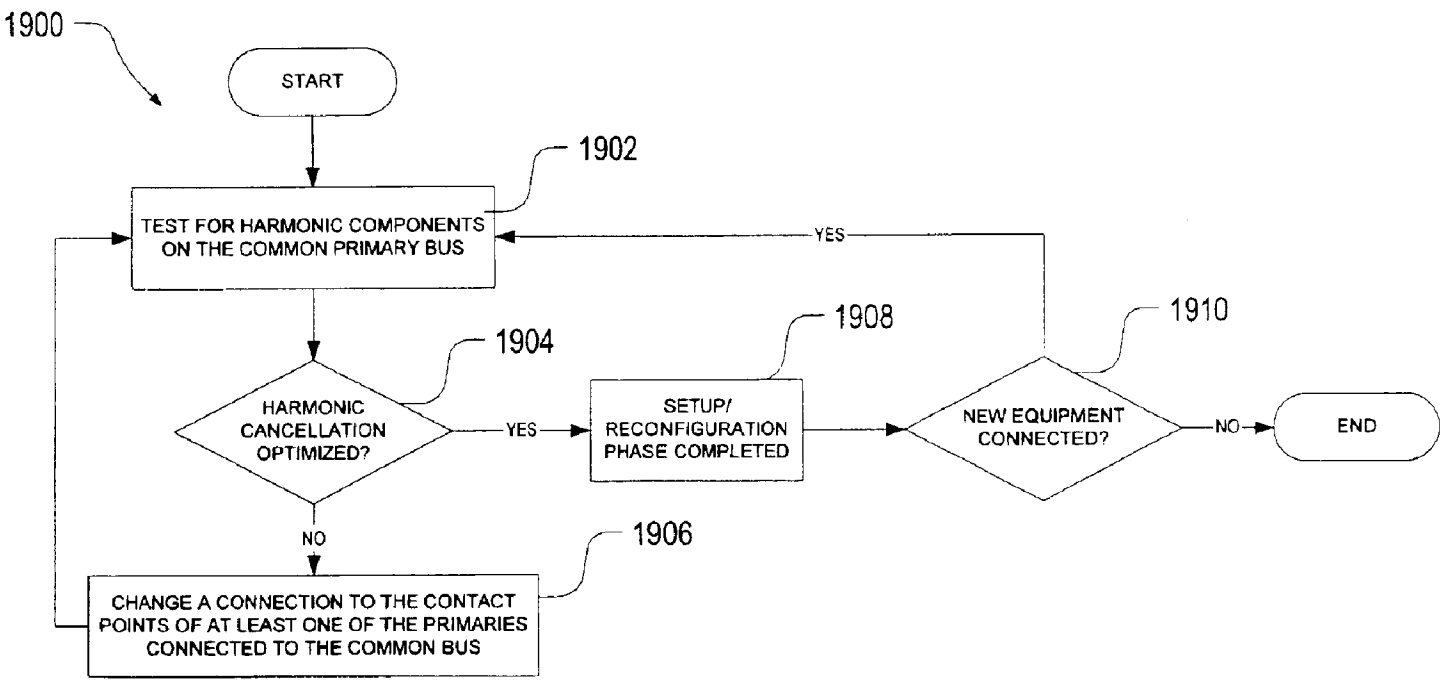

FIG. 19 is a flowchart 1900 illustrating how transformers are maintained and adjusted after they are connected to the primary bus 112 as described above with reference to FIG. 18, in accordance with the invention. In step 1902, the primary bus 112 is tested for harmonics using methods and equipment that are well known in the art. If harmonics identified, are not substantially canceled on the primary bus, it is determined in step 1904 that harmonic cancellation of an identified order is not cancelled by the installed transformers in a current configuration. Accordingly a connection of the contact points of at least one of the primaries 102A.104A connected to the primary bus 112 is changed to mitigate the observed harmonics. The set of contact points that should be changed is determined based on the harmonics that exist on the common bus 112. After the contact points are changed in step 1906, the process returns to step 1902 and the process is re-iterated until all of the connection configurations have been tested, or the harmonics on the primary bus 112 are substantially canceled, as determined in step 1904. In embodiments where a plurality of transformers are used, the step of selecting the set of contact points involves selecting sets of connections at any of the primaries of the transformers. It will further be noted that the step of changing the contacts may further involve steps of changing settings on voltage adjustment taps, and in-field reconfiguring the connections of the windings to provide a desired configuration, depending on the embodiment of the primary.

If, in step 1904, it is determined that the investigated harmonics are substantially canceled, the setup or reconfiguration stage of the process is complete (step 1908). When new equipment is connected to any of the secondaries 102B, 104B (step 1910) the steps of testing 1902, determining if harmonic cancellation is optimized 1904 and reconnecting 1906 are repeated until all connection combinations are tried, or the harmonics on the primary bus 112 are substantially canceled. While the method of FIG. 19 is described with respect to the pair of transformers illustrated in FIG. 1, the same method applies equally to any other embodiment of the invention.

As will be understood by those skilled in the art, steps 1902–1906 may only be performed on a periodic basis, or when a substantial change in the configuration of equipment powered by the power distribution system occurs, and not each time a new load is added to the secondary side of one of the transformers.

Figure 20:
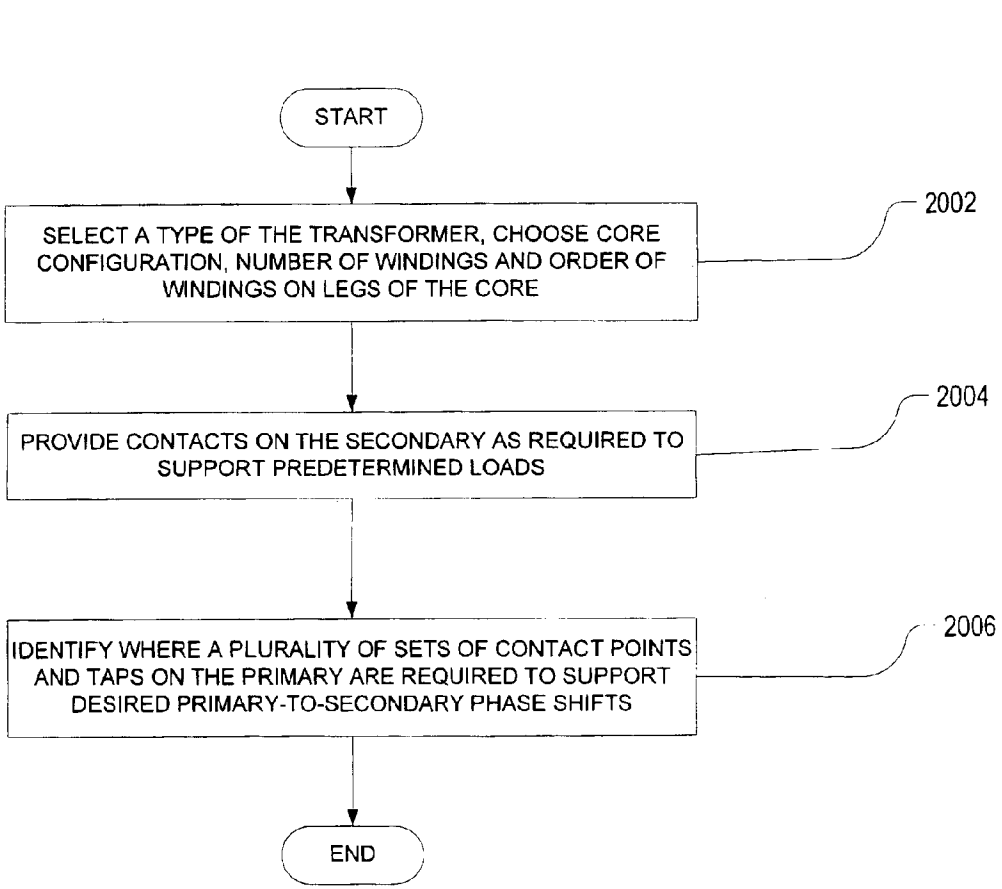

FIG. 20 is a flow chart 2000 illustrating principal steps involved in designing a transformer that permits the in-field modification to adjust a primary-to-secondary phase shift, in accordance with the invention. In step 2002, a type of the transformer is chosen. This involves selecting a configuration of the core, which may be an E-shaped, or an E-coupled with an I-shaped core. As is well known in the art, other core configurations are possible. A number and order of windings on the legs of the core is chosen. As will be appreciated by those of skill in the art, the design of the primary concurrently with that of the secondary enables an order of primary and secondary windings to be chosen in relation to the legs of the core. Any of the open and closed configurations illustrated herein and their equivalents may be chosen. The designer must provide contact points at (step 2004) ends of the secondary to support loads. Finally the designer identifies (step 2006) contact points and taps on the windings of the primary that are needed to provide the alternative connections with the power source in order to support the desired primary-to-secondary phase shifts. Accordingly the designer may include voltage adjustment taps, and reconfigurable connections to ends and taps of the primary windings as are needed to mitigate identified harmonics, or may provide the permanent connections supporting the different sets of contact points needed to provide the desired primary-to-secondary phase shifts.

The embodiments of the invention described above are intended to be exemplary only. It will be apparent to those skilled in the art that modifications and adaptations may be made to these embodiments without departing from the scope of the invention. The scope of the invention is therefore intended to be limited solely by the scope of the appended claims.

We claim:

1. A field-adjustable phase shifting transformer for canceling harmonic currents in a three-phase alternating current (AC) power distribution system, the transformer comprising:

a primary having a plurality of sets of contact points for receiving power from a three-phase AC power source; and a secondary electromagnetically coupled to the primary, the secondary having at least one set of contact points for connection to a plurality of loads, the secondary being wound in one of a wye-connected, a wye connected zig-zag, and zig-zag wye-connected configuration, wherein each set of contact points of the primary provides a respective phase shift of a current of the primary relative to a voltage of the primary.

2. The transformer as claimed in claim 1 wherein the primary has two sets of three-wire contact points.

3. The transformer as claimed in claim 2 wherein a first phase shift is about 15° and a second phase shift is about −15°.

4. The transformer as claimed in claim 2 wherein the primary comprises three windings connected in a delta-star configuration.

* * * * *